US005931001A

United States Patent [19]

Watanabe et al.

[11] Patent Number: 5,931,001

[45] Date of Patent: Aug. 3, 1999

[54] AIR-CONDITIONING VENTILATOR

[75] Inventors: Hideo Watanabe, Kawasaki; Motohiro Sakai, Yokohama; Fumikazu Kiya, Noboribetsu, all of Japan

[73] Assignee: Thermovonics Co., Ltd., Kanagawa, Japan

[21] Appl. No.: 08/872,193

[22] Filed: Jun. 10, 1997

[30] Foreign Application Priority Data

Jun. 10, 1996 [JP] Japan ..... 8-147430

[51] Int. Cl.[6] ..... F25B 21/02; F24H 3/02

[52] U.S. Cl. ..... 62/3.7; 62/3.2; 165/54

[58] Field of Search ..... 62/3.7, 3.2, 404, 62/407; 165/54, 164.31

[56] References Cited

U.S. PATENT DOCUMENTS 3,205,667 9/1965 Frantti ..... 62/3.7

5,544,487 8/1996 Attey et al. ..... 62/3.7

FOREIGN PATENT DOCUMENTS 2-219936 9/1990 Japan .

*Primary Examiner*—Henry Bennett
*Assistant Examiner*—Melvin Jones
*Attorney, Agent, or Firm*—Evenson, McKeown, Edwards & Lenahan, P.L.L.C.

[57] ABSTRACT

An air-conditioning ventilator is provided with an air inlet passage and an air outlet passage for ventilation and also with a heat exchanger making use of a thermoelectric module for effecting an exchange of heat with air flowing through one of the passages. At least one of a heat-absorbing system and a heat-dissipating system of the heat exchanger is provided with a heat-transfer-medium-circulating system so that a heat transfer medium is forced to circulate in a liquid form for performing the exchange of heat.

11 Claims, 20 Drawing Sheets

AIR-CONDITIONING VENTILATOR

BACKGROUND OF THE INVENTION a) Field of the Invention

This invention relates to an air-conditioning ventilator usable, for example, in a house, a store or a building other than such a house or store. In particular, the present invention is concerned with an air-conditioning ventilator excellent in heat-exchanging efficiency.

b) Description of the Related Art

In recent years, there is an increasing move toward houses with higher air tightness owing to the installation of window sashes and the like. Due to insufficient natural ventilation, however, air fouled with tobacco smoke and the like tends to stagnate inside rooms or the like. Unless ventilation is sufficient during the rainy season, dew may be formed on walls, thereby inducing growth of mold or the like. Insufficient ventilation is therefore insanitary.

Opening of a window or door of an air-conditioned room for ventilation is however uneconomical, because when the room is air-conditioned for cooling, the temperature of the room becomes higher to reduce the effects of the cooling and when the room is air-conditioned for heating, the temperature of the room conversely becomes lower to reduce the effects of the heating. Further, the opening of the window or door also leads to inconvenience such that noise of cars, an airplane or the like enters the room and that at night, radio or TV sound leaks out and may give an annoyance to the neighbors.

To cope with such problems, ventilating fans provided with a heat-exchanging function have been used conventionally. According to such a conventional ventilating fan, an air outlet passage for exhausting foul indoor air to the outside and an air inlet passage for introducing fresh outdoor air into the room are arranged adjacent to each other, and a thermal conductor made of a metal or the like is disposed between the air outlet passage and the air inlet passage.

When discharging foul indoor air to the outside through the air outlet passage and introducing fresh outdoor air into the room through the air inlet passage at the same time by the ventilating fan, an exchange of heat takes place via the thermal conductor between the air to be discharged to the outside and that to be introducing from the outside, whereby heat is recovered to make smaller a reduction in the effects of cooling or the effects of heating.

Incidentally, the recovery rate of heat via a thermal conductor by a ventilating fan having such a heat-exchanging function is as low as 50 to 70% or so. Upon ventilation, heat is therefore not recovered sufficiently, resulting in a change in room temperature. The air-conditioned pleasant environment cannot be maintained accordingly.

With a view to eliminating the above drawback, an air-conditioning ventilator has been proposed as disclosed in Japanese Patent Application Laid-Open (Kokai) No. HEI 2-219936. This air-conditioning ventilator is constructed to make combined use of an upstream-side heat exchanger with a thermal conductor arranged between an air inlet passage and an air outlet passage and a downstream-side heat exchanger with a thermoelectric module disposed astride the air inlet passage and the air outlet passage.

The combined use of the upstream-side heat exchanger equipped with the thermal conductor and the downstream-side heat exchanger equipped with the thermoelectric module makes it possible to increase the heat recovery rate to some extent. There is however a limitation to such an increase, so that the controllable temperature range is narrow and insufficient.

Further, the upstream-side heat exchanger and the downstream-side heat exchanger are formed in an integral structure, resulting in a large air-conditioning ventilator. Its installation in an upper part of a wall or the like requires a support of a large structure for the air-conditioning ventilator. The air-conditioning ventilator therefore sticks out considerably from a surface of the wall and becomes an eyesore. As another drawback, the air-conditioning ventilator is heavy.

SUMMARY OF THE INVENTION

An object of the present invention is to eliminate such drawbacks of the conventional art, and to provide an air-conditioning ventilator which has a wide controllable temperature range and a good heat-exchanging efficiency (thermal responsibility) and permits both size and weight reductions at a portion to be installed in an upper part of an interior wall To achieve the above object, the present invention is directed to an air-conditioning ventilator provided with an air inlet passage and an air outlet passage for ventilation and also with a heat exchanger making use of a thermoelectric module for effecting an exchange of heat with air flowing through one of said passages.

The present invention is characterized in that at least one of a heat-absorbing system and a heat-dissipating system of said heat exchanger is provided with a heat-transfer-medium-circulating system so that a heat transfer medium, for example, water or an antifreeze is forced to circulate in a liquid form for performing said exchange of heat.

According to the air-conditioning ventilator according to the present invention, the heat-transfer-medium-circulating system is arranged in the heat exchanger.

Owing to the forced circulation of the heat transfer medium, it is possible to efficiently and promptly perform, for example, cooling or heating of air introduced through the air inlet passage. This has made it possible to extend the controllable temperature range.

Further, the arrangement of the heat-transfer-medium-circulating system can divide from each other a section provided with the thermoelectric module and its accessory members and a heat transfer section to which supply air or exhaust air is brought into contact (for example, a second heat-absorbing-side heat transfer unit or a second heat-dissipating-side heat transfer unit, both of which will be described subsequently herein). It is therefore possible to reduce the air inlet passage and/or the air outlet passage in both size and weight by arranging only the heat transfer unit in the air inlet passage and/or the air outlet passage and the thermoelectric module and its accessory members such as a pump and a fan at another place, for example, outdoors.

DETAILED DESCRIPTION OF THE INVENTION AND PREFERRED EMBODIMENTS

Figure 5:
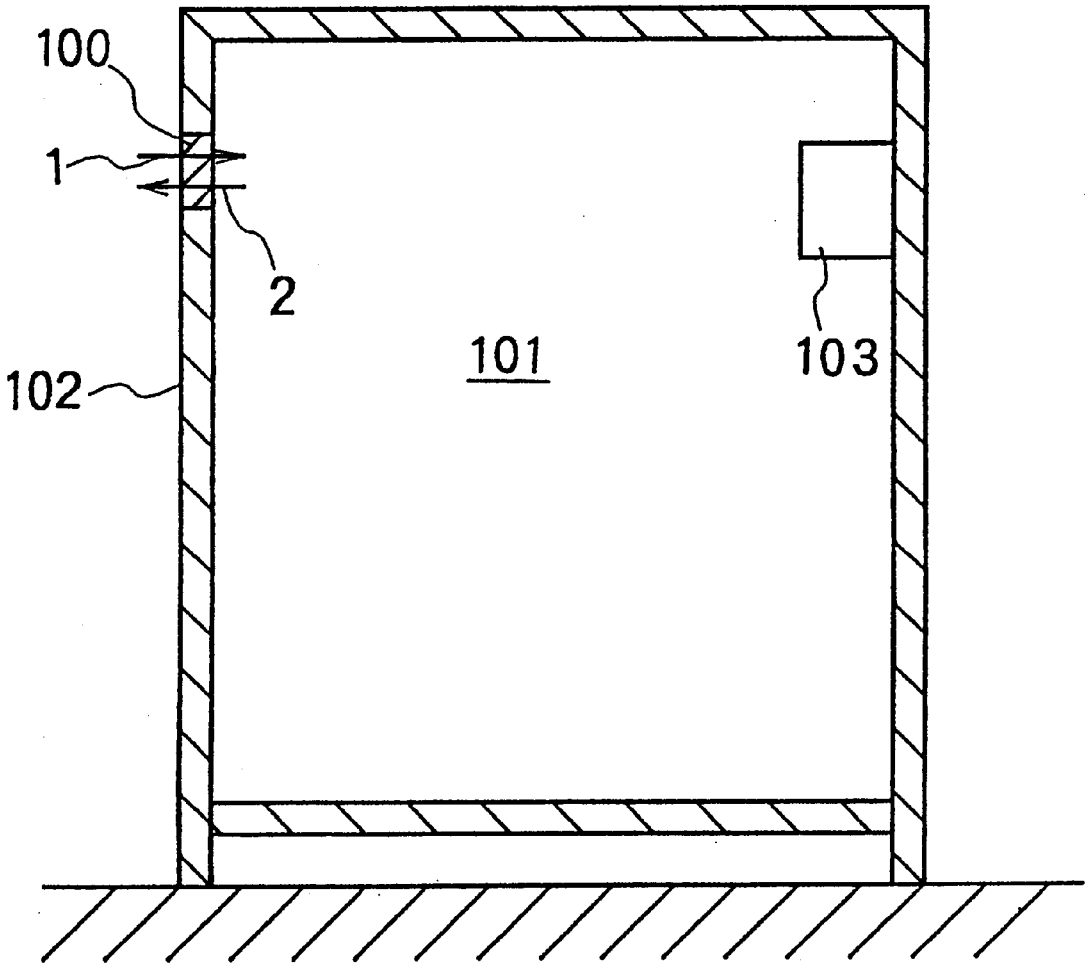
FIG. 5 is a diagram showing an installation example of the air-conditioning ventilator.

The air-conditioning ventilator according to the respective embodiments of the present invention can be divided into a single heat exchanger type in which a first heat exchanger making use of a thermoelectric transducer is used singly and a combined heat exchanger type in which another heat exchanger of a different construction, such as a second heat exchanger making use of a thermal conductor, is used in combination with the above-mentioned first heat exchanger. As is illustrated in FIG. 5, an air-conditioning ventilator 100 of the above construction is either partly or wholly in an upper part of a wall 102 defining a room 101 so that the inside and the outside of the room 101 are communicated with each other. Ventilation of the room 101 is performed through the air-conditioning ventilator 100 and at the same time, heat is recovered so that cooling or heating is not impaired. In this diagram, numeral 103 indicates a cooling-and-heating air conditioner arranged on the wall 102 at a different location.

Figure 1:
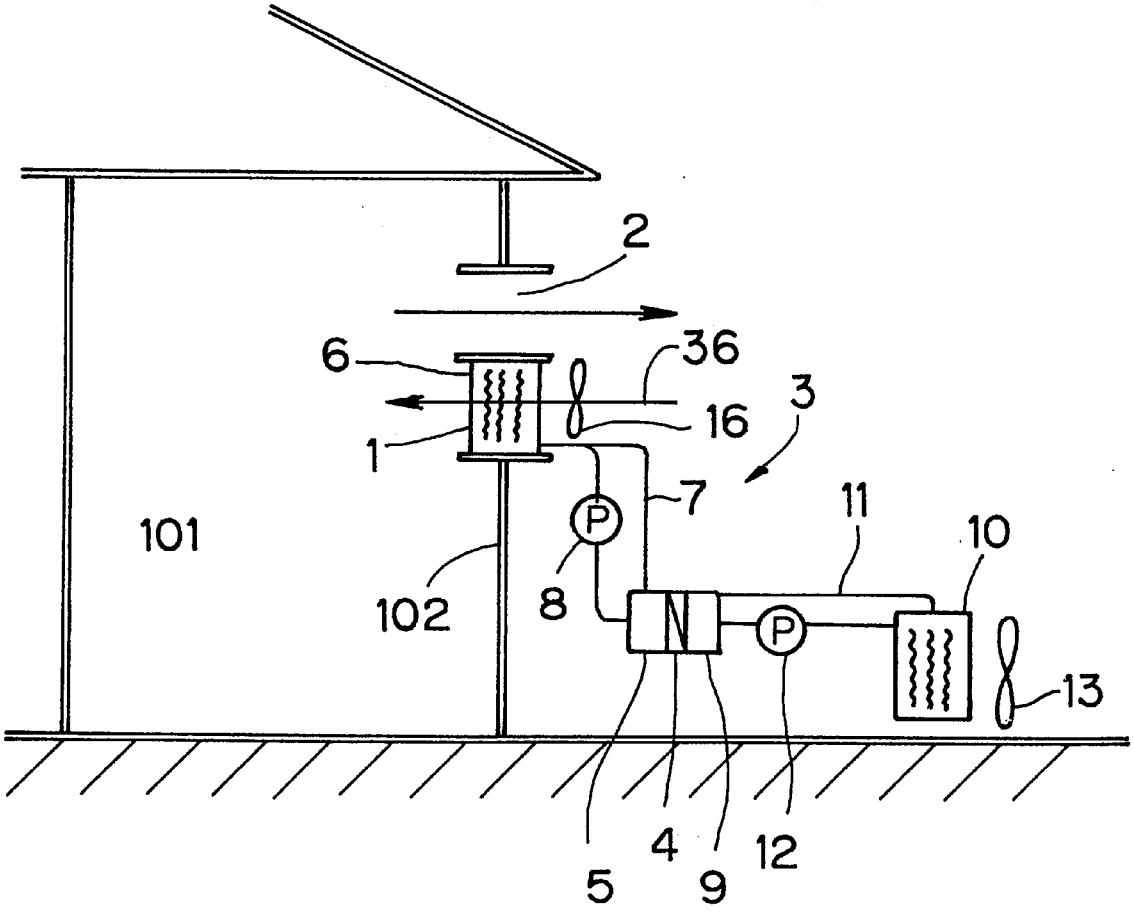
FIG. 1 is a schematic construction diagram of an air-conditioning ventilator according to a first embodiment of the present invention.

A description will first be made of the embodiments of the single heat exchanger type. Referring to FIG. 1 which illustrates the schematic construction of the air-conditioning ventilator according to the first embodiment, a description will be made about a case in which the room 101 is cooled. As is depicted in the diagram, an air inlet passage 1 and an air outlet passage 2 are arranged for ventilation in an upper part of the wall 102. The function of the air outlet passage 2 is only to exhaust foul air from the room 101 to the outside. An exchange of heat is performed with respect to fresh air which is supplied from the outside to the inside of the room 101 through the air inlet passage 1.

Figure 2:
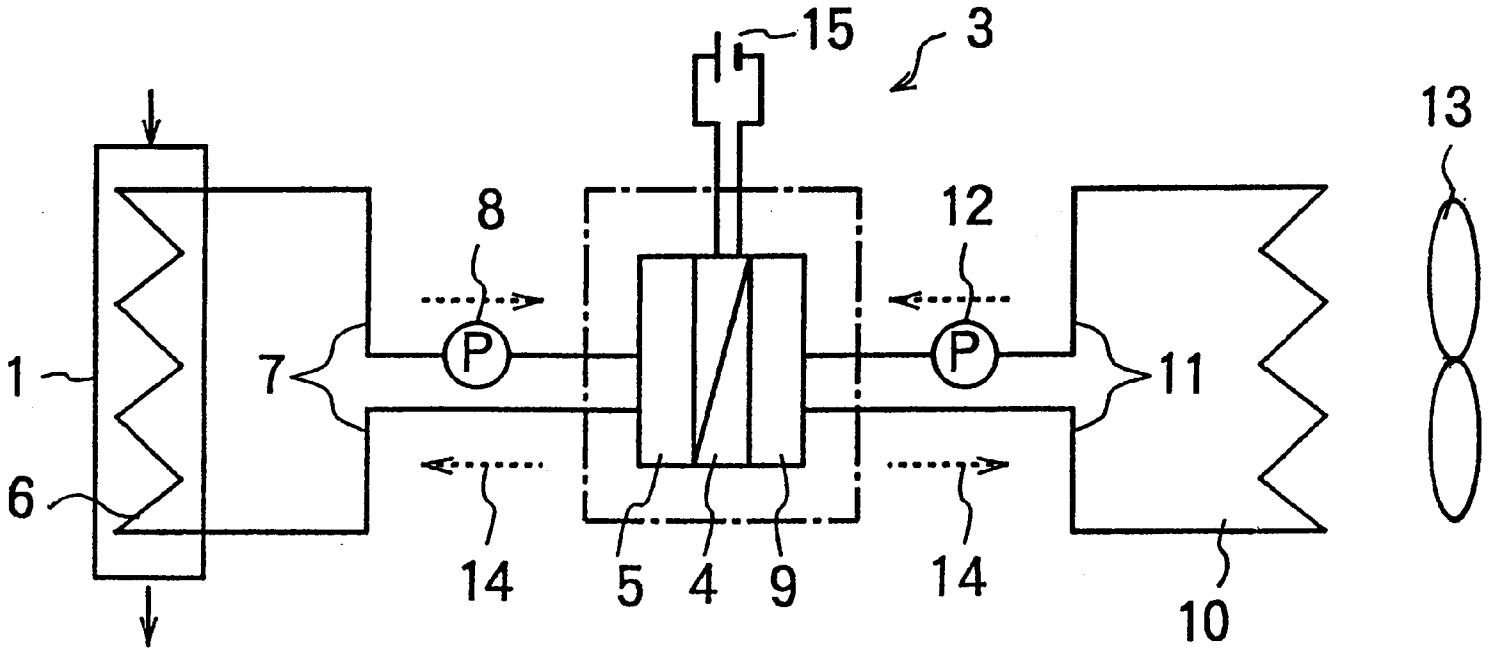
FIG. 2 is a schematic construction diagram of a first heat exchanger used in the air-conditioning ventilator.

With reference to FIGS. 1 and 2, the construction of a first heat exchanger 3 for performing the exchange of heat will be described. The first heat exchanger 3 is constructed inter alia of a thermoelectric module 4 having the Peltier effect (and composed of a heat-absorbing-side substrate, a heat-dissipating-side substrate, a heat-absorbing-side electrode, a heat-dissipating-side electrode, and numerous P-type semiconductors and N-type semiconductors arranged between the heat-absorbing-side electrode and the heat-dissipating-side electrode), a first heat-absorbing-side heat transfer unit 5 arranged adjacent to a heat-absorbing side of the thermoelectric module 4, a second heat-absorbing-side heat transfer unit 6 of the radiator type arranged in the air inlet passage 1, a heat-absorbing-side circulating passage 7 formed of a tube which communicates the first heat-absorbing-side heat transfer unit 5 and the second heat-absorbing-side heat transfer unit 6 with each other, a heat-absorbing-side pump 8 arranged in the heat-absorbing-side circulating passage 7 at an intermediate point thereof, a first heat-dissipating-side heat transfer unit 9 arranged adjacent to a heat-dissipating side of the thermoelectric module 4, a second heat-dissipating-side heat transfer unit 10 of the radiator type, a heat-dissipating-side circulating passage 11 formed of a tube which communicates the first heat-dissipating-side heat transfer unit 9 and the second heat-dissipating-side heat transfer unit 10 with each other, a heat-dissipating-side pump 12 arranged in the heat-dissipating-side circulating passage 11 at an intermediate point thereof, a heat-dissipating-side fan 13 arranged adjacent to a heat-dissipating surface of the second heat-dissipating-side heat transfer unit 10, a heat transfer medium 14 made of a liquid (for example water) and filled in the heat-absorbing-side circulating passage 7 and the heat-dissipating-side circulating passage 11 (see FIG. 2), and a power supply 15 for supplying electric power to the thermoelectric module 4.

A heat-absorbing system of the heat exchanger 3 is constructed of the first heat-absorbing-side heat transfer unit 5, the second heat-absorbing-side heat transfer unit 6, the heat-absorbing-side circulating passage 7, the heat-absorbing-side pump 8, and the heat transfer medium 14 filled in the heat-absorbing-side circulating passage 7. On the other hand, the heat-dissipating system of the heat exchanger 3 is constructed of the first heat-dissipating-side heat transfer unit 9, the second heat-dissipating-side heat transfer unit 10, the heat-dissipating-side circulating passage 11, the heat-dissipating-side pump 12, the heat-dissipating-side fan 13, and the heat transfer medium 14 filled in the heat-dissipating-side circulating passage 11. The thermoelectric module 4 is arranged at a position where the heat-absorbing system and the heat-dissipating system are joined together.

Although not shown in the drawings, the above-described heat-absorbing system and heat-dissipating system are each additionally provided with gas venting means for venting gas such as air which is contained in the heat transfer medium 14.

As is shown in FIG. 1, an air supply fan 16 of the forced draft type or the suction type and a filter (not shown) are arranged in the vicinity of an opening of the air inlet passage 1. Further, the second heat-absorbing-side heat transfer unit 6 is arranged in the air inlet passage 1 in such a way that supply air is allowed to flow through the second heat-absorbing-side heat transfer unit 6. The remaining components of the heat exchanger 3 are arranged outside the house or room in view of space and noise.

The second heat-absorbing-side heat transfer unit 6 is arranged in a wall opening in FIG. 1. If it is arranged outside the room and a duct is arranged extending through the wall, the area of the opening in the wall can be made small and at the same, the portion striking into the inside of the room can also be reduced.

Figure 3:
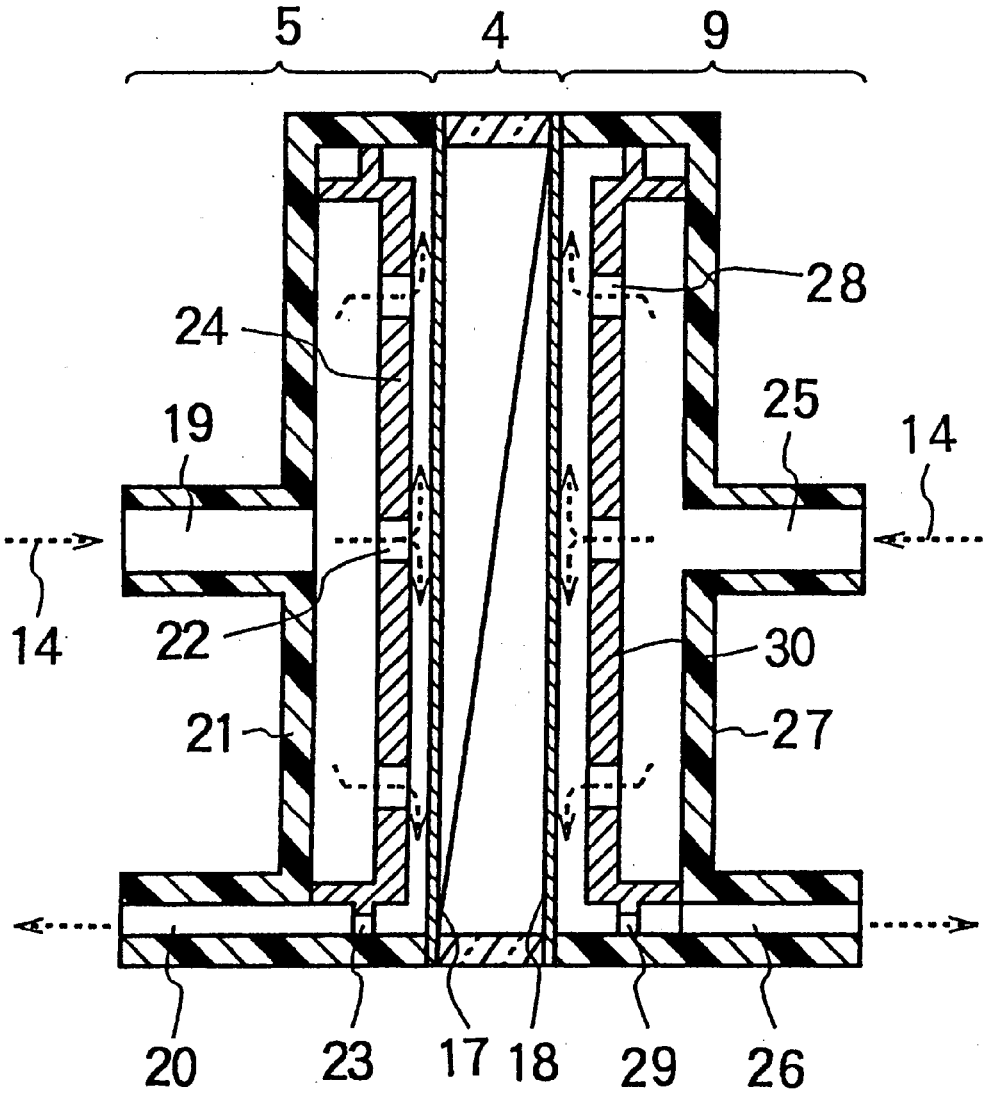
FIG. 3 is a cross-sectional view showing a package of a thermoelectric module and a heat transfer unit in the first heat exchanger.

The thermoelectric module 4, the first heat-absorbing-side heat transfer unit 5 and the first heat-dissipating-side unit 9 are put together into a single package, and the structure of the package is shown in FIG. 3. A heat-absorbing-side substrate 17 and a heat-dissipating-side substrate 18 of the thermoelectric module 4 are each formed of a metal plate, such as an aluminum plate, with an electrically-insulating thin film of alumina or the like formed on a surface thereof. In addition, a heat-absorbing-side or heat-dissipating-side electrode (not shown) of the thermoelectric module 4 is disposed on the electrically-insulating thin film.

Joined on an outer side of the heat-absorbing-side substrate 17 is a flattened heat-absorbing-side frame 21, which widely opens toward the heat-absorbing-side substrate 17 and is provided on a side opposite to the heat-absorbing-side substrate 17 with a water inlet 19 and a water outlet 20. A distributing plate 24 with plural distributing holes 22 and collecting holes 23 defined therethrough is arranged within an internal space of the heat-absorbing-side frame 21. The distributing holes 22 are in communication with the water inlet 19, while the collecting holes 23 are in communication with the water outlet 20.

The heat-dissipating side has the same construction as the heat-absorbing side. Joined on an outer side of the heat-dissipating-side substrate 18 is a flattened heat-dissipating-side frame 27, which widely opens toward the heat-dissipating-side substrate 18 and is provided on a side opposite to the heat-dissipating-side substrate 18 with a water inlet 25 and a water outlet 26. A distributing plate 28 with plural distributing holes 28 and collecting holes 29 defined therethrough is arranged within an internal space of the heat-dissipating-side frame 27. The distributing holes 28 are in communication with the water inlet 25, while the collecting holes 29 are in communication with the water outlet 26.

With reference to FIG. 3, the thermoelectric module 4 making use of the metal-made heat-absorbing-side substrate 17 and the heat-dissipating-side substrate 18 has been described. It is however also possible to use a conventional module which is provided with usual substrates.

Figure 4:
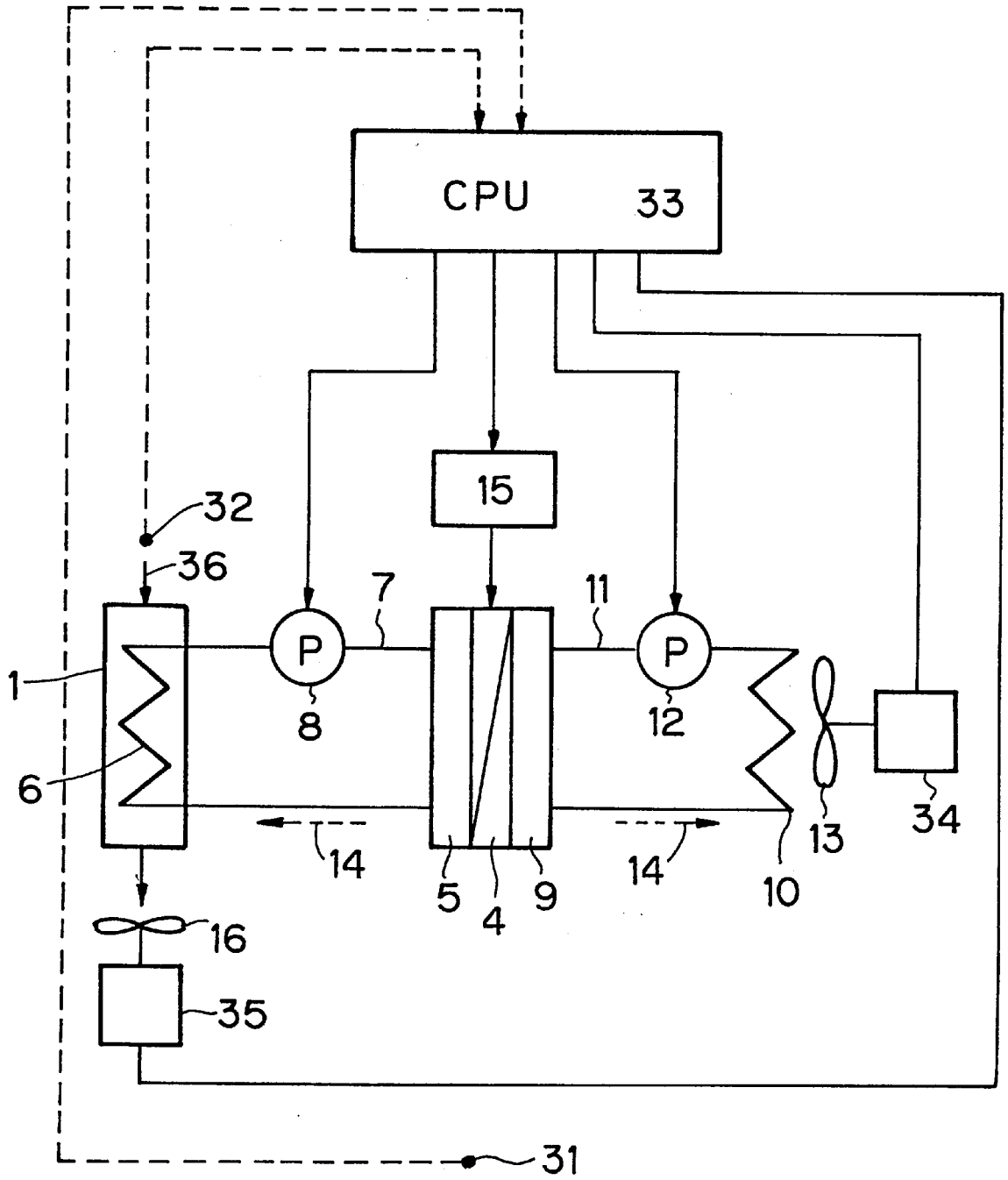
FIG. 4 is a control system diagram for the first heat exchanger (air-conditioning ventilator)

FIG. 4 illustrates the control system for the first heat exchanger 3. An indoor temperature sensor 31 is arranged inside the room for detecting an indoor temperature T1, while an outside air temperature sensor 32 is disposed outside the house (room) to detect an outside air temperature $T_2$. Output signals of the indoor temperature sensor 31 and the outside air temperature sensor 32 are inputted at predetermined intervals to a control unit 33 which is composed of a microcomputer (CPU), whereby a difference between the indoor temperature T1 and the outside air temperature T2 is computed. Based on the temperature difference, the coefficient of performance (COP) of the first heat exchanger 3 and a like parameter, a value of electric power to be supplied to the thermoelectric module 4, a circulating flow rate of the heat-absorbing-side heat transfer medium 14 by the heat-absorbing-side pump 8, a circulating flow rate of the heat-dissipating-side heat transfer medium 14 by the heat-dissipating-side pump 12, an air supply rate by the heat-dissipating-side fan 13 (a rotating speed of a heat-dissipating-side fan motor 34 for driving the heat-dissipating-side fan 13) and an air supply rate to the room 101 by the air supply fan 16 (namely, a rotating speed of the air supply fan motor 35 for driving the air supply fan 16) are controlled either individually or in an associated fashion.

The operation principle of the air-conditioning ventilator will be described primarily with reference to FIG. 1 and FIG. 4. When the air inside the room 101 is fouled, for example, by tobacco smoke and other smell and the air supply fan 16 is driven, fresh outdoor supply air 36 of a high temperature is introduced into the air inlet passage 1 through a filter.

The supply air 36, which has been introduced into the air inlet passage 1, then flows through the second heat-absorbing-side heat transfer unit 6 of the radiator type, so that an exchange of heat is promptly effected with the heat-absorbing-side heat transfer medium 14 which is under forced circulation. As a consequence, the room temperature is lowered to a preset cooling temperature. The supply air 36 is introduced into the room in this embodiment, so that the foul air inside the room is naturally or forcedly (no air exhaust fan is shown in FIG. 1) exhausted to the outside of the house through the air outlet passage 2.

As is illustrated in FIG. 3, the heat-absorbing-side heat transfer medium 14, which has absorbed heat from the supply air 36, enters the heat-absorbing-side frame 21 through the water inlet 19 of the first heat-absorbing-side heat transfer unit 5 and hits the distributing plate 24, so that the heat-absorbing-side heat transfer medium 14 is caused to disperse. The heat-absorbing-side heat transfer medium 14 is therefore caused to flow rapidly through the plural distributing holes 22 toward the heat-absorbing-side substrate 17. Since the heat-absorbing-side substrate 17 is cooled owing to a supply of electric power to the thermoelectric module 4, the heat-absorbing-side heat transfer medium 14 is efficiently cooled while it hits the heat-absorbing-side substrate 17 in substantially a perpendicular direction and then flows along the outer surface of the heat-absorbing-side substrate 17. The heat-absorbing-side heat transfer medium 14 then circulates back to the second heat-absorbing-side heat transfer unit 6 through the water outlet 20, and again contributes to the cooling of the supply air 36.

The heat, which has moved to the heat-absorbing-side substrate 17, is transferred to the heat-dissipating-side 18 via the thermoelectric module 4. At the first heat-dissipating-side heat transfer unit 9, the heat is absorbed in the heat-dissipating-side heat transfer medium 14. The heat is transferred further via the heat-dissipating-side circulating passage 11 to the second heat-dissipating-side heat transfer unit 10, where the heat is dissipated by air supplied from the heat-dissipating-side fan 34. The heat-dissipating-side heat transfer medium 14 again contributes to the transport of heat.

According to this embodiment, the indoor temperature sensor 31 and the outside air temperature sensor 32 are used to determine a difference between an indoor temperature and an outside air temperature. Based on the temperature difference, the coefficient of performance (COP) of the first heat exchanger 3 and a like parameter, a value of electric power to be supplied to the thermoelectric module 4, a circulating flow rate of the heat-absorbing-side heat transfer medium 14 by the heat-absorbing-side pump 8, a circulating flow rate of the heat-dissipating-side heat transfer medium 14 by the heat-dissipating-side pump 12, an air supply rate by the heat-dissipating-side fan 13 (a rotating speed of the heat-dissipating-side fan motor 34 for driving the heat-dissipating-side fan 13), an air supply rate to the room 101 by the air supply fan 16 (namely, a rotating speed of the air supply fan motor 35 for driving the air supply fan 16) and the like are computed, followed by the initiation of driving of the heat exchanger 3.

The temperature of the heat-exchanged supply air 36 is measured by the indoor temperature sensor 31. It is monitored by the CPU 33 whether or not the temperature is equal to a preset indoor temperature. If not, the temperature difference is then computed to correct at least one of the value of electric power to be supplied to the thermoelectric module 4, the circulating flow rate of the heat-absorbing-side heat transfer medium 14 by the heat-absorbing-side pump 8, the circulating flow rate of the heat-dissipating-side heat transfer medium 14 by the heat-dissipating-side pump 12, the air supply rate by the heat-dissipating-side fan 13 (namely, the rotating speed of the heat-dissipating-side fan motor 34 for driving the heat-dissipating-side fan 13) and the air supply rate to the room 101 by the air supply fan 16 (namely, the rotating speed of the air supply fan motor 35 for driving the air supply fan 16).

Figure 6:
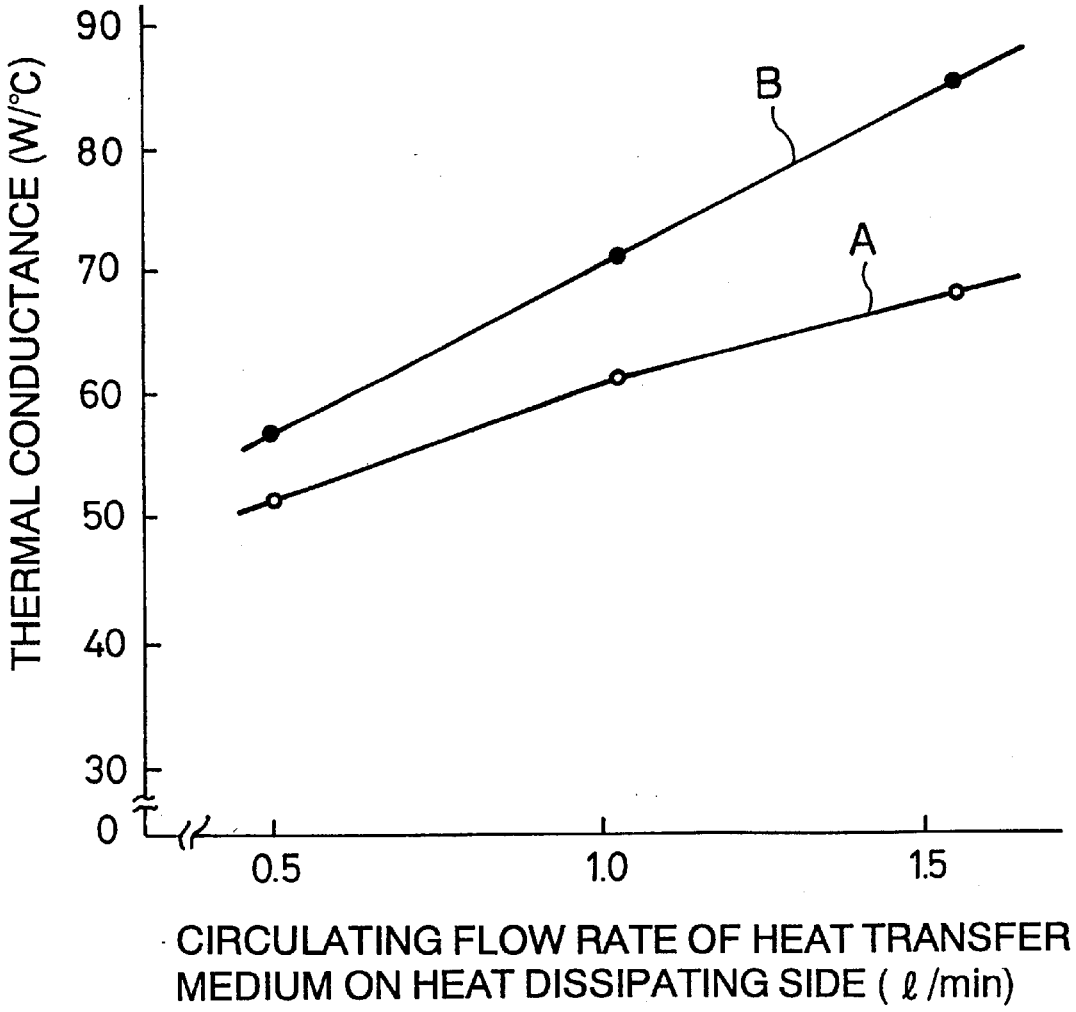
FIG. 6 is a characteristic diagram showing a relationship between various circulating flow rates of a heat transfer medium and corresponding values of thermal conductance.

FIG. 6 is the characteristic diagram which shows the relationship between circulating flow rates of the heat-dissipating-side heat transfer medium and their corresponding values of thermal conductance. In a test conducted to prepare the characteristic diagram, a radiator of 225 mm in width and 320 mm in height was used as the second heat-absorbing-side heat transfer unit, and a pump of 300 mm in impeller diameter was employed as the heat-absorbing-side pump. The pump was driven at 3.5 V (curve A) and 4.5 V (curve B).

As is appreciated from the diagram, the thermal conductance of the second heat-absorbing-side heat transfer unit can be controlled to an adequate value to cool the supply air 36 down to a desired temperature if even at the same drive voltage, the rotating speed of the heat-absorbing-side pump is changed to adjust the circulating flow rate of the heat-absorbing-side heat transfer medium or if the drive voltage of the heat-absorbing-side pump is changed.

Figure 7:
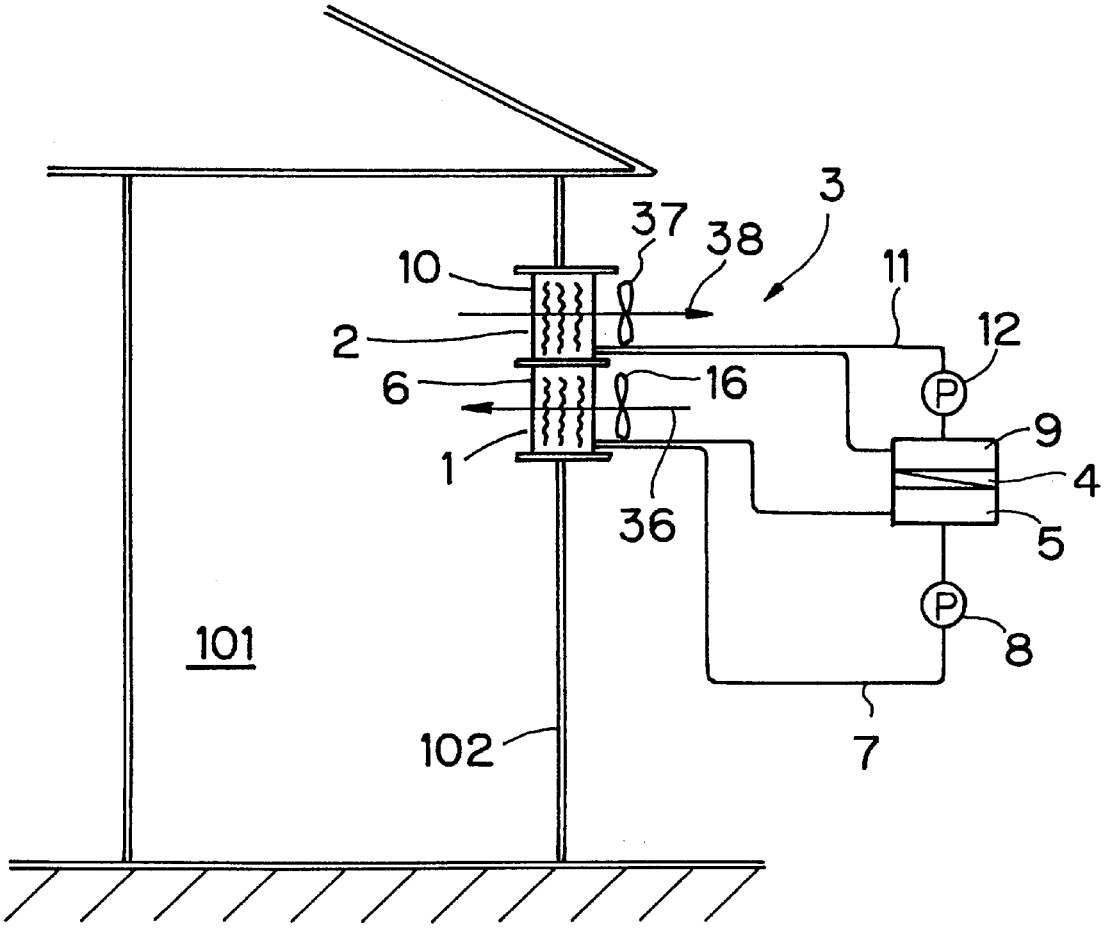
FIG. 7 is a schematic construction diagram of an air-conditioning ventilator according to a second embodiment of the present invention.

FIG. 7 is the schematic construction diagram of the air-conditioning ventilator according to the second embodiment of the present invention. In this embodiment, the second heat-dissipating-side heat transfer unit 10 is arranged in the air outlet passage 2 and an exhaust fan 37 is disposed in the vicinity of the opening of the air outlet passage 2.

The arrangement of the second heat-dissipating-side heat transfer unit 10 in the air outlet passage 2 makes it possible to cool the heat-dissipating-side heat transfer medium 14, which is forcedly circulating through the heat-dissipating-side circulating passage 11, by low-temperature exhaust air 38 which is exhausted outdoors from the room 101.

Figure 8:
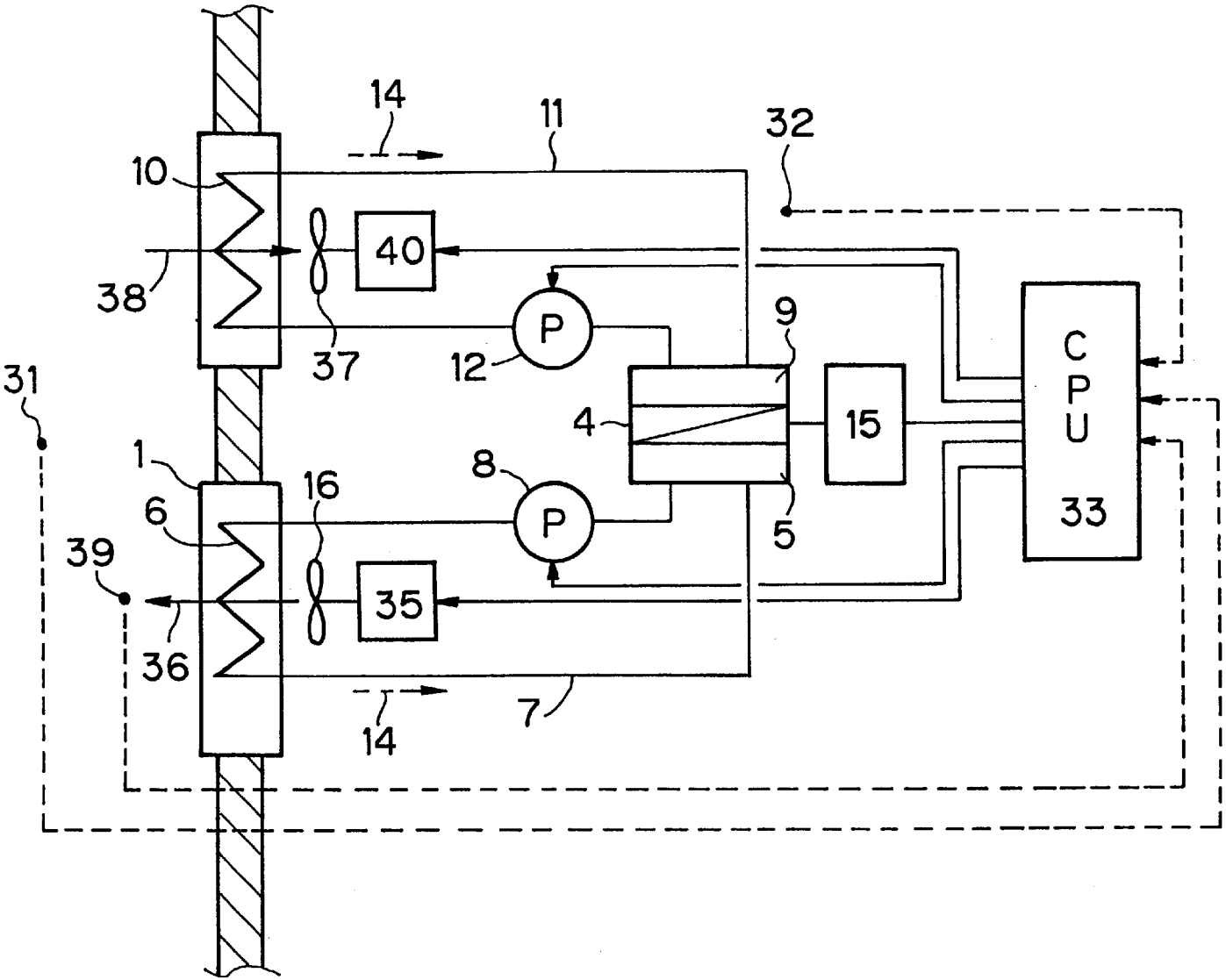
FIG. 8 is a control system diagram for the air-conditioning ventilator of FIG. 7.

FIG. 8 illustrates the control system for the air-conditioning ventilator according to the second embodiment. In this embodiment, a supply air temperature sensor 39 is arranged near the opening of the air inlet passage 1 to detect the temperature of the supply air 36 which has been cooled through the second heat-absorbing-side heat transfer unit 6.

Output signals of the indoor temperature sensor 31, the outside air temperature sensor 32 and the supply air temperature sensor 39 are inputted to the control unit (CPU) 33, whereby a difference between the indoor temperature and the outside air temperature and a difference between the indoor temperature and the supply air temperature are computed, respectively. Based on the results of these computation, the coefficient of performance (COP) of the first heat exchanger 3 and a like parameter, a value of electric power to be supplied to the thermoelectric module 4, a circulating flow rate of the heat-absorbing-side heat transfer medium 14 by the heat-absorbing-side pump 8, a circulating flow rate of the heat-dissipating-side heat transfer medium 14 by the heat-dissipating-side pump 12, an air supply rate to the room 101 by the air supply fan 16 (namely, a rotating speed of the air supply fan motor 35 for driving the fan 16) and an air exhaust rate from the room 101 by the exhaust fan 37 (namely, a rotating speed of the exhaust fan motor 40 for driving the air exhaust fan 37) are controlled either individually or in an associated fashion.

Figure 9:
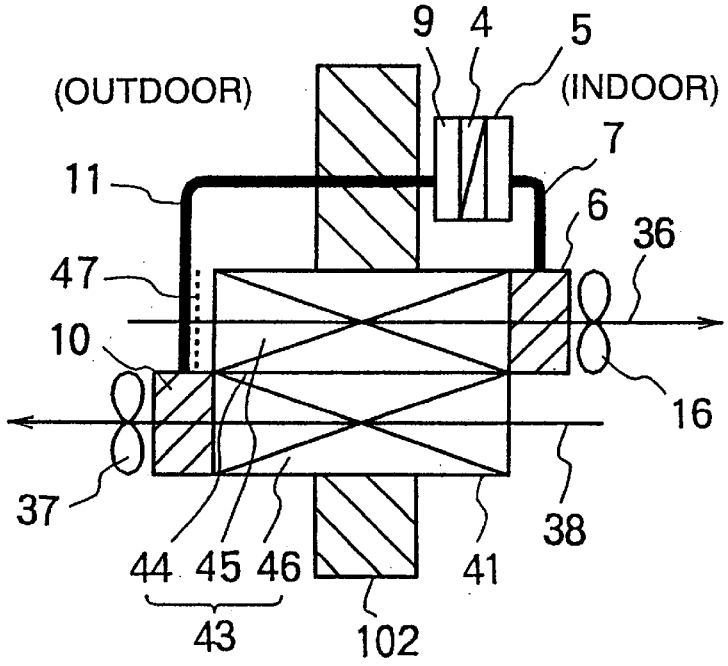
FIG. 9 is a schematic construction diagram of an air-conditioning ventilator according to a third embodiment of the present invention.

FIG. 9 schematically illustrates the construction of the air-conditioning ventilator according to the third embodiment of the present invention. In this embodiment, a second heat exchanger equipped with a thermal conductor is used in combination with the above-described first heat exchanger 3 which is constructed of the thermoelectric module 4, the first heat-absorbing-side heat transfer unit 5, the second heat-absorbing-side heat transfer unit 6, the heat-absorbing-side circulating passage 7 (indicated by a single thick line), the heat-absorbing-side pump 8 (not shown), the first heat-dissipating-side heat transfer unit 9, the second heat-dissipating-side heat transfer unit 10, the heat-dissipating-side circulating passage 11 (indicated by a single thick line), the heat-dissipating-side pump 12 (not shown), the heat transfer medium 14 (not shown) and the like.

Figure 10:
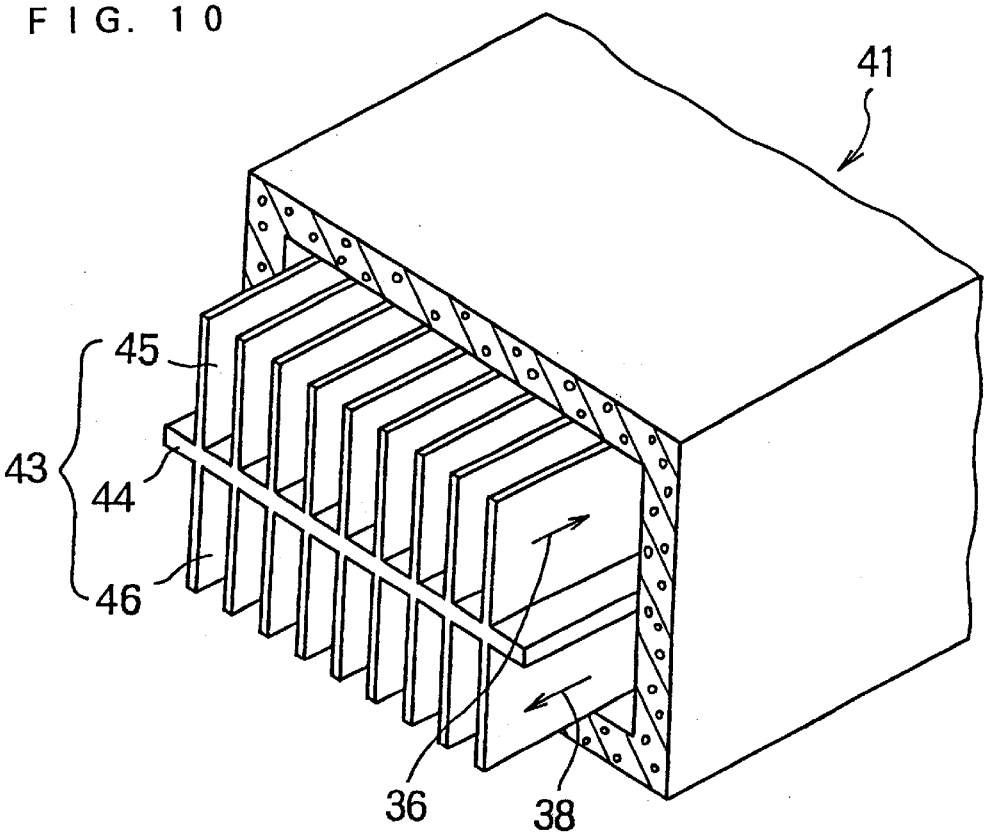
FIG. 10 is a fragmentary perspective view of a second heat exchanger employed in the air-conditioning ventilator of FIG. 9.

As is depicted in FIG. 10, the second heat exchanger 41 is provided with a thermal conductor 43, which is made of aluminum or the like and is arranged between an air inlet passage 1 and an air outlet passage 2. The air inlet passage 1 and the air outlet passage 2 are formed with outer peripheries thereof surrounded by a heat-insulated duct 42. The thermal conductor 43 is composed of a base plate 44, first fins 45 and second fins 46. The base plate 44 extends in the direction of the air inlet passage 1 and the air outlet passage 2 so that these passages are divided from each other by the base plate 44. The first fins 45 extend into the air inlet passage 1 from the base plate 44, while the second fins 46 extends into the air outlet passage 2 from the base plate 44. As is illustrated in FIG. 9, a filter 47 is arranged at an inlet of the air inlet passage 1 to prevent dust and the like from flowing into a room through the air inlet passage 1.

A description will next be made about the operation principle of the air-conditioning ventilator. When the air inside the room is fouled, for example, by tobacco smoke and other smell and the fans 16,37 are driven, fresh outdoor supply air 36 of a high temperature is introduced into the air inlet passage 1 through the filter 47 and at the same time, the foul indoor air of a low temperature is introduced into the exhaust passage 2.

The supply air 36 introduced into the air inlet passage 1 is first brought into contact with the first fins 45 having a wide heat transfer area, while the low-temperature exhaust air introduced into the exhaust passage 2 is brought into contact with the second fins 46 having a wide heat transfer area. An exchange of heat is therefore performed directly between the supply air 36 and the exhaust air 38 via the thermal conductor 43.

As a result of this exchange of heat, the supply air 36 is lowered in temperature, is cooled down further to a preset temperature of cooling by the second heat-absorbing-side heat transfer unit 6 arranged on an outlet side of the air inlet passage 1, and is supplied into the room. On the other hand, the exhaust air 38 takes part in the cooling of the supply air 36 while it passes by the second fins 46 and through the second heat-dissipating-side heat transfer unit 10, and is then exhausted through an opening of the air outlet passage 2.

Figure 11:
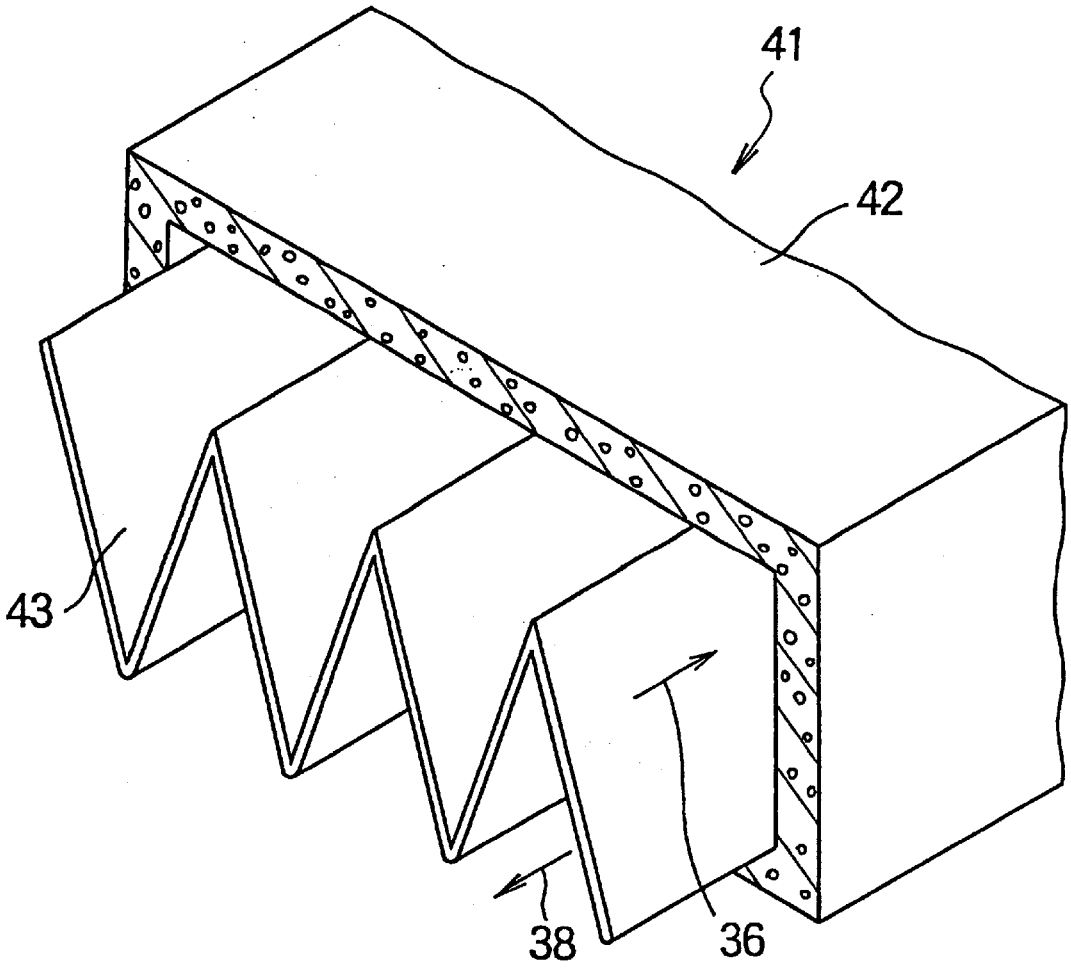
FIG. 11 is a fragmentary perspective view depicting a modification of the second heat exchanger.

FIG. 11 illustrates the modification of the second heat exchanger 41. In this modification, the air inlet passage 1 and the air outlet passage 2 are easily formed by inserting a thermal conductor 43 in the heat-insulated duct 42. The thermal conductor 43 has been formed by folding a thin synthetic resin plate (for example, a thin polyethylene or polyamide plate) or a metal plate (for example, an aluminum or stainless steel plate) in a zig-zag pattern. A thin synthetic resin plate sufficiently functions as the thermal conductor 43. The thermal conductor 43 made of a synthetic resin is therefore recommended especially for an exchange of heat with a fluid which contains a corrosive component such as a sulfurizing component, an oxidizing component and/or moisture.

Figure 12:
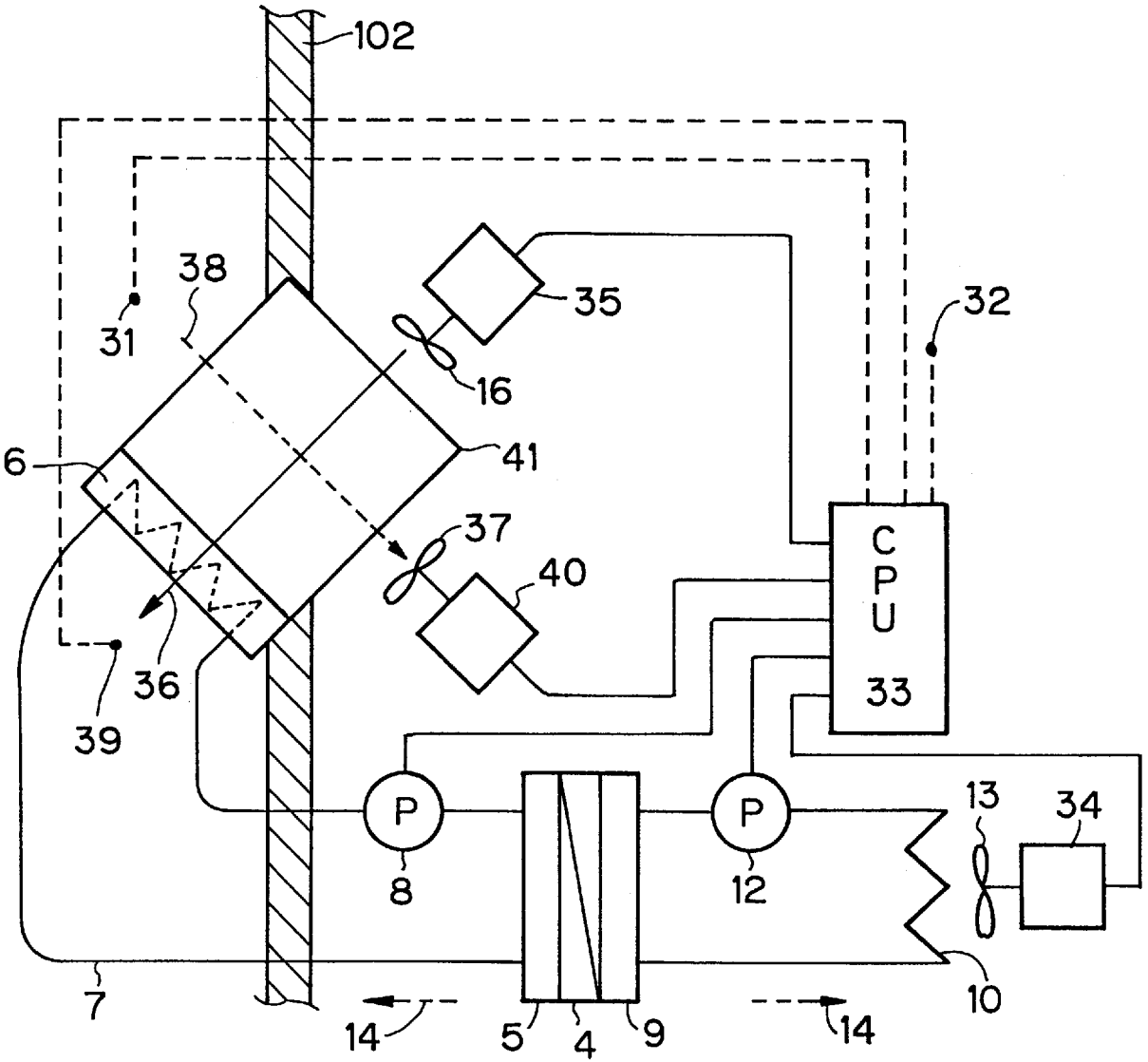
FIG. 12 is a schematic construction diagram of an air-conditioning ventilator according to a fourth embodiment of the present invention.

FIG. 12 schematically shows the construction of the air-conditioning ventilator according to the fourth embodiment of the present invention. This embodiment also makes combined use of a first heat exchanger 3 and a second heat exchanger 41. Similarly to the foregoing, the first heat exchanger 3 is constructed of the thermoelectric module 4, the first heat-absorbing-side heat transfer unit 5, the second heat-absorbing-side heat transfer unit 6, the heat-absorbing-side circulating passage 7, the heat-absorbing-side pump 8, the first heat-dissipating-side heat transfer unit 9, the second heat-dissipating-side heat transfer unit 10, the heat-dissipating-side circulating passage 11, the heat-dissipating-side pump 12, the heat transfer medium 14 and the like.

Figure 13:
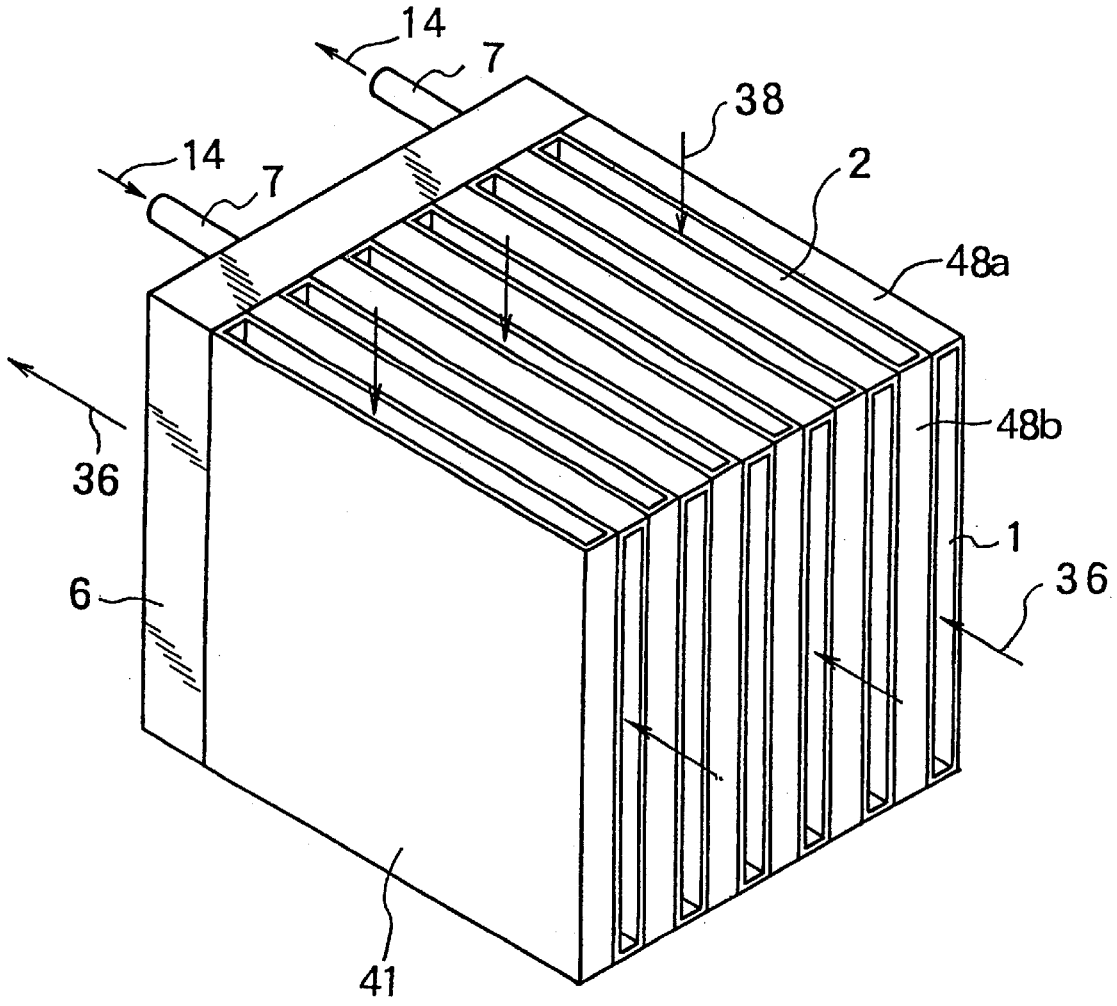
FIG. 13 is a fragmentary perspective view of a second heat exchanger employed in the air-conditioning ventilator of FIG. 12.

As is depicted in FIG. 13, an air inlet passage 1, through which supply air 36 flows, and an air outlet passage 38, through which exhaust air 38 flows, are arranged in such a way that the flowing directions of the supply air 36 and the exhaust air 38 cross at a right angle. The air inlet passage 1 and the air outlet passage 2 have been constructed in a multicellular form by arranging many flattened boxes 48*a*, 48*b* side by side in a contiguous relation. These flatted boxes 48*a*,48*b* are each made of a thermal conductor (which is in turn made of synthetic resin plate or metal plate) and defines a through-hole extending in one direction. On a downstream side of the air inlet passage 1 of the second heat exchanger 41, the second heat-absorbing-side heat transfer unit 6 of the first heat exchanger 3 is arranged.

In this embodiment, the fully box-shaped members are used to form the multicellular air inlet passage 1 and air outlet passage 2. For the simplification of their fabrication, it is also possible to form the multicellular air inlet passage 1 and air outlet passage 2 by stacking many members, each of which has been cut off substantially at one side wall thereof and has a square U-shaped cross-section, together so that the through-holes of the every second members extend at right angles relative to the through-holes of the remaining (namely, every first) members.

Figure 14:
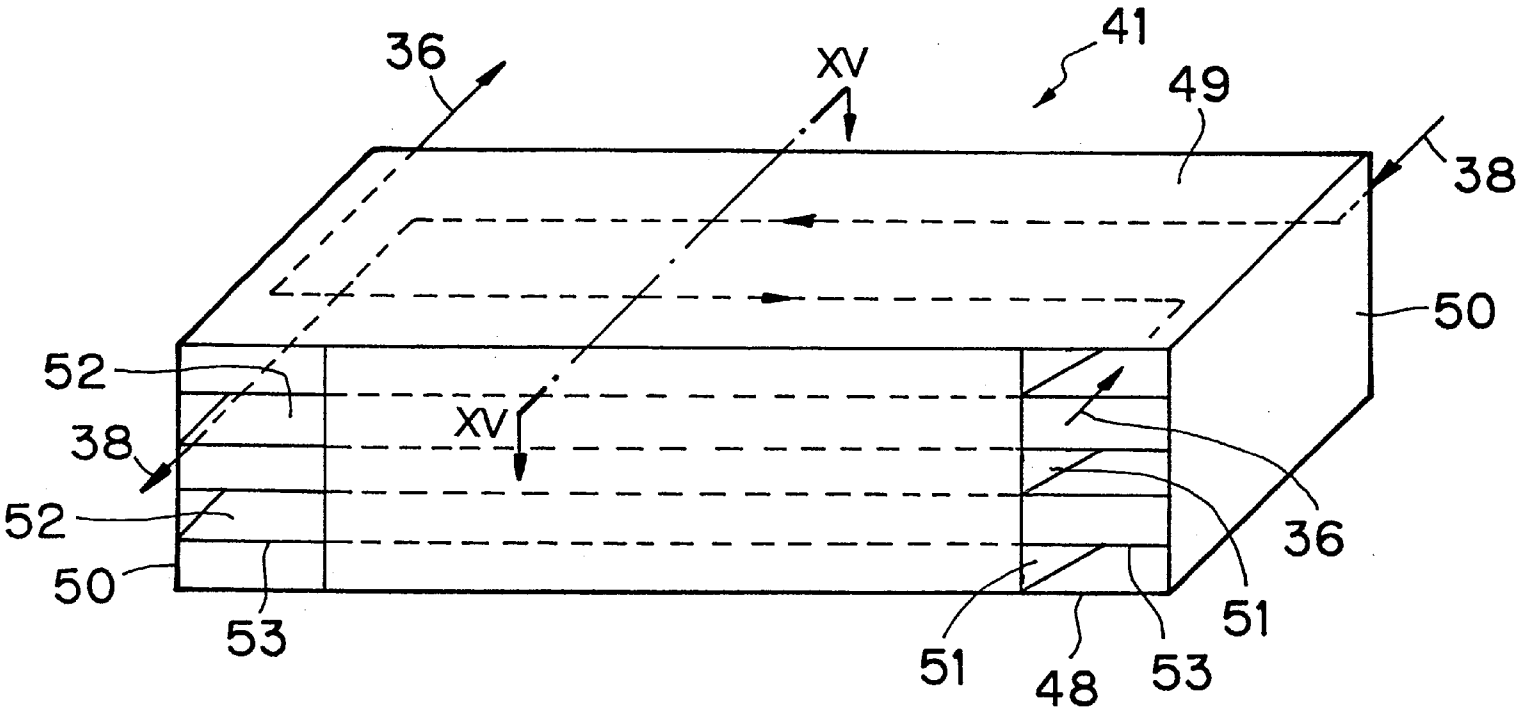
FIG. 14 is a fragmentary perspective view depicting a modification of the second heat exchanger of FIG. 13.
Figure 15:
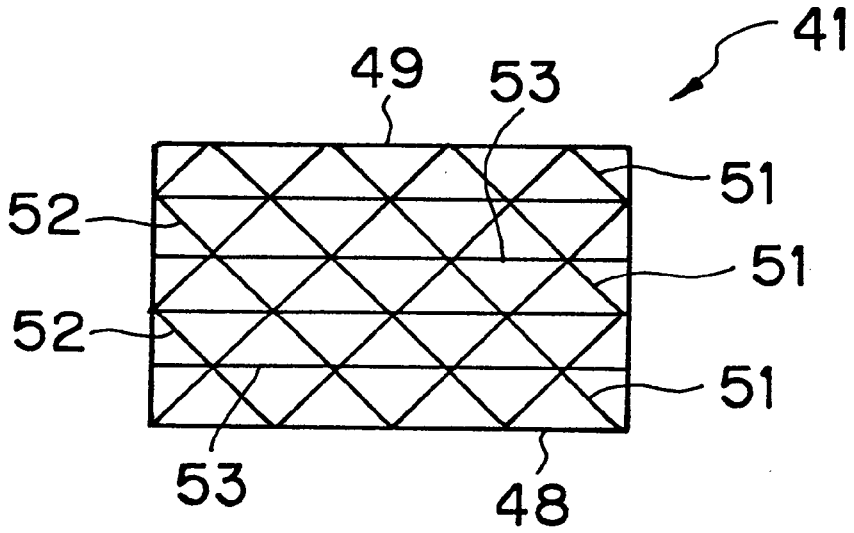
FIG. 15 is a cross-sectional view taken in the direction of arrows XV—XV of FIG. 14.
Figure 16:
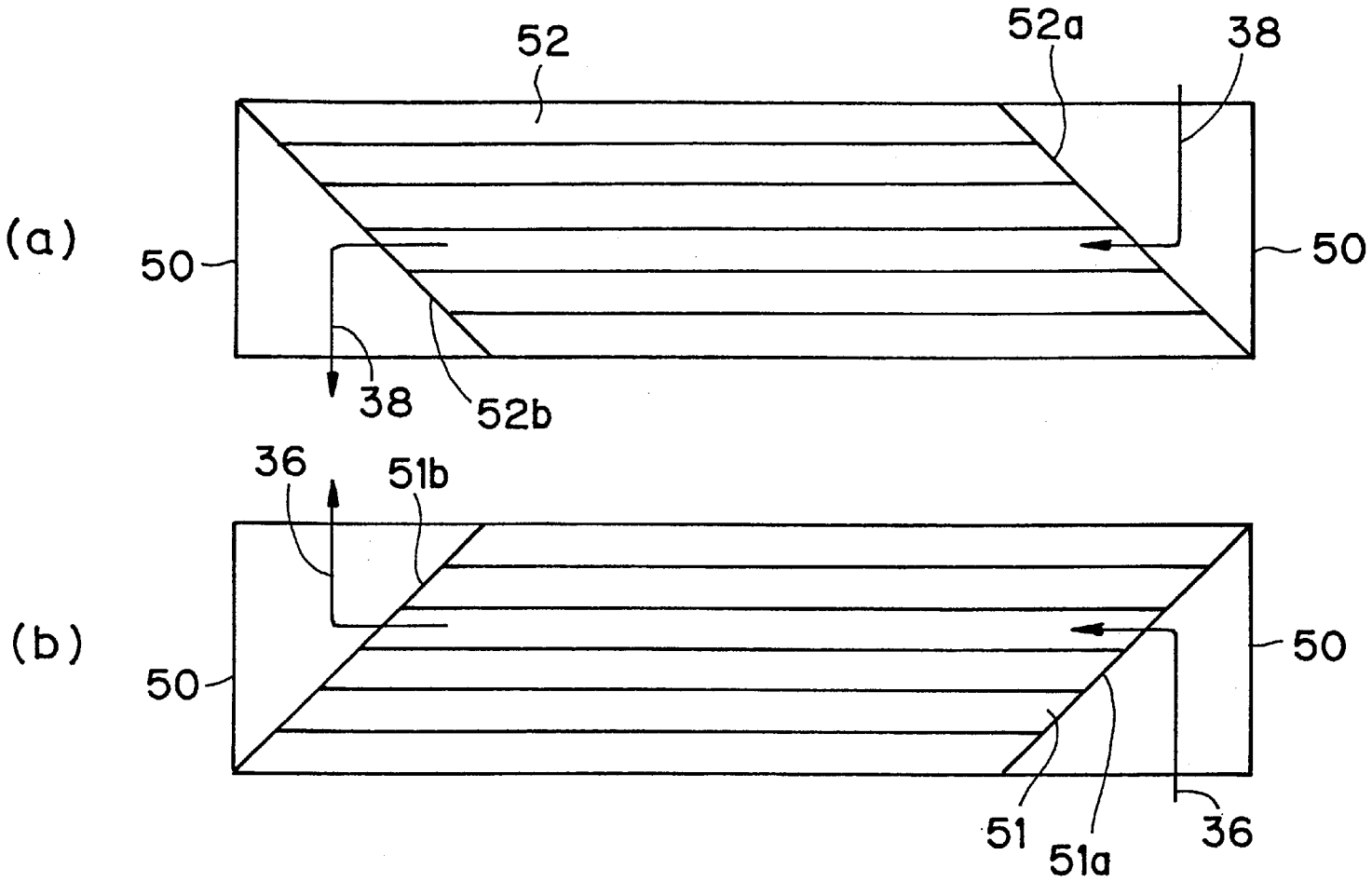
FIG. 16 is a diagram illustrating flows of supply air and exhaust air through the second heat exchanger of FIG. 14.
Figure 17:
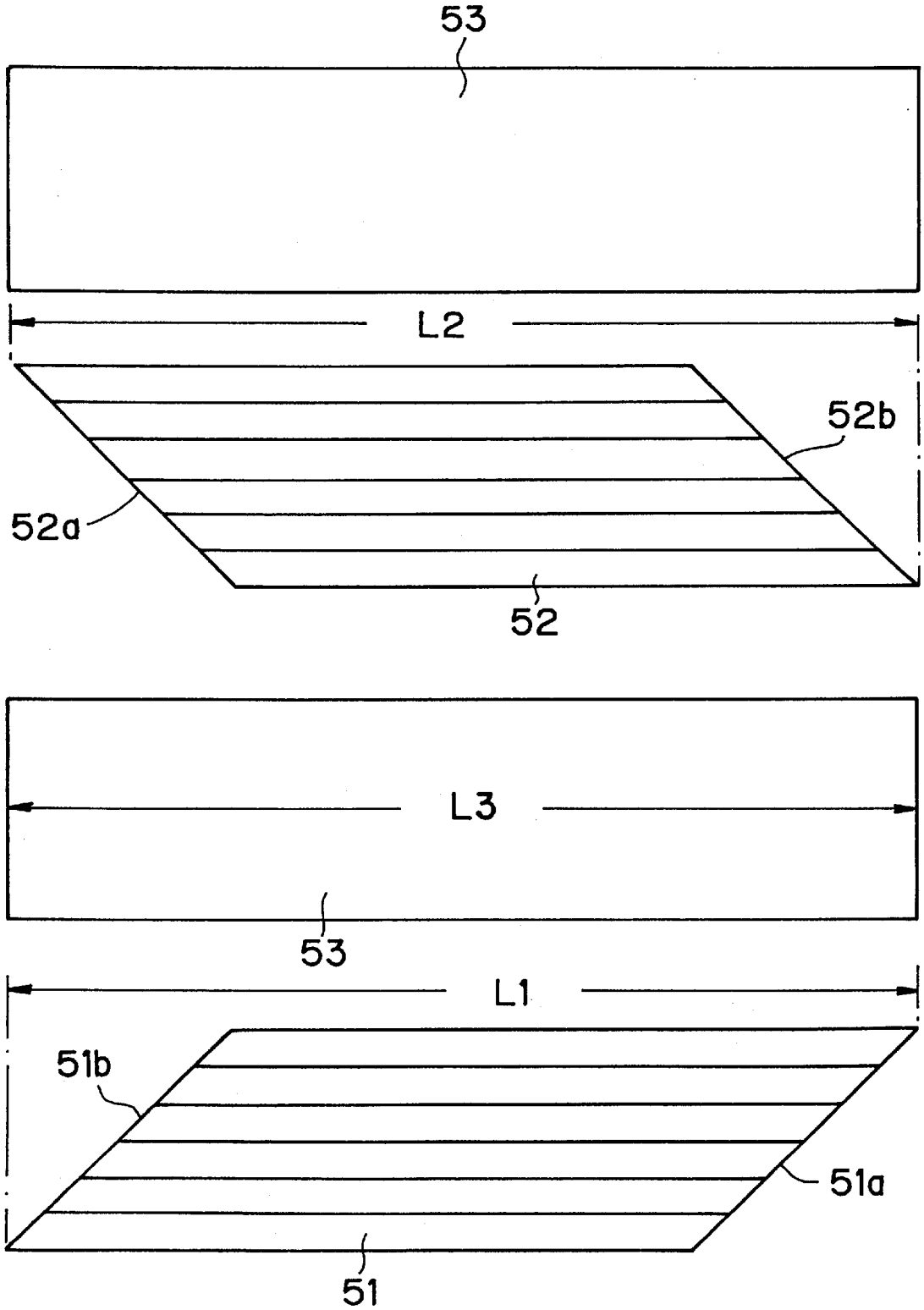
FIG. 17 is a plan view of principal components of the second heat exchanger of FIG. 14.

FIG. 14 through FIG. 17 shows the modification of the heat exchanger 41. FIG. 14 is the perspective view of a heat exchanger 41, FIG. 15 is the cross-sectional view taken in the direction of arrows XV—XV of FIG. 14, FIG. 16 schematically illustrates flows of supply air and exhaust air, and FIG. 17 shows the principal components of the heat exchanger 41 in plan.

The heat exchanger 41 according to this modification is composed principally of a bottom plate 48, a top plate 49, side plates 50, first corrugated plates 51, second corrugated plates 52, and divider plates 53 arranged between the first corrugated plates 51 and the second corrugated plates 52.

As is shown in FIG. 17, the first corrugated plates 51 and second corrugated plates 52 are parallelogrammatic in shape as viewed in plan. Each first corrugated plate 51 is cut with shorter sides 51*a*,51*b* extending in an upper rightward direction as viewed on the drawing sheet, whereas each second corrugated plate 52 is cut with shorter sides 52*a*,52*b* extending in a lower rightward direction as viewed on the drawing sheet. The length L1 of each first corrugated plate 51, the length L2 of each second corrugated plate 52 and the length L3 of each divider plate 53 are equal to each other. The first corrugated plates 51, the divider plates 53 and the second corrugated plates 52 and the divider plates 53 are alternately stacked together as many plates as predetermined. The top plate 49 and the bottom plate 48 are brought into contact with the top and bottom surfaces, respectively, and the side plates 50 are brought into contact with the opposite side surfaces, respectively, whereby the heat exchanger 41 of such a regular parallelepipedal shape as shown in FIG. 14 and FIG. 15 is constructed.

At least each divider plate 53 is composed of a thermal conductor. In this modification, the first corrugated plates 51, the second corrugated plates 52 and the divider plates 53 are all composed of thermal conductors.

By alternately stacking the first corrugated plates 51 and the second corrugated plates 52, which are parallelelogrammatic in shape as viewed in plan, one over the other with the divider plates 53 interposed therebetween, the following groups of the shorter sides 51*a*,51*b*,52*a*,52*b* of the first and second corrugated plates 51,52 are exposed in four corner portions of the heat exchanger 41: the group of the shorter sides 51*a* of the first corrugated plates 51, the group of the shorter sides 51*b* of the first corrugated plates 51, the group of the shorter sides 52*a* of the second corrugated plates 52, and the group of the shorter sides 52*b* of the second corrugated plates 52.

As is illustrated in FIG. 14 and FIG. 16, in this modification, the corner portion where the group of the shorter sides 51*a* of the first corrugated plates 51 is exposed (the nearer right corner portion of the heat exchanger 41 of FIG. 14) serves as an inlet for the supply air 36, the corner portion where the group of the shorter sides 51*b* of the first corrugated plates 51 is exposed (the farther left corner portion of the heat exchanger 41 of FIG. 14) serves as an outlet for the supply air 36, the corner portion where the group of the shorter sides 52*a* of the second corrugated plates 52 is exposed (the farther right corner portion of the heat exchanger 41 of FIG. 14) serves as an inlet for the exhaust air 38, and the corner portion where the group of the shorter sides 52*b* of the second corrugated plates 52 is exposed (the nearer left corner portion of the heat exchanger 41 of FIG. 14) serves as an outlet for the exhaust air 38.

The supply air 36 is introduced through the corner portion where the group of the shorter sides 51*a* of the first corrugated plates 51 is exposed, flows in the direction of the lengths of the first corrugated plates 51 through spaces formed between the first corrugated plates 51 and their associated lower and upper divider plates 53, and then flows out through the corner portion where the group of the shorter sides 51*b* of the first corrugated plates 51 is exposed. On the other hand, the exhaust air 38 is introduced through the corner portion where the group of the shorter sides 52*a* of the second corrugated plates 52 is exposed, flows in the direction of the lengths of the second corrugated plates 52 through spaces formed between the second corrugated plates 52 and their associated lower and upper divider plates 53, and then flows out through the corner portion where the group of the shorter sides 52*b* of the second corrugated plates 52 is exposed. The supply air 36 and the exhaust air 38 therefore flow as alternate parallel layers in opposite directions. In the course of the flow, an exchange of heat is effected via the divider plates 53.

In this heat exchanger, the recovery rate of heat between the supply air 36 and the exhaust air 38 can be made higher by increasing the lengths L1,L2,L3 of the corrugated plates 51,52 and the divider plates 53.

In this modification, grooves of the first corrugated plate 51 extend in the same direction as those of the second corrugated plate 52. As an alternative, the corrugated plates 51,52 can be arranged with their grooves extending in directions which cross each other at a small angle.

Figure 18:
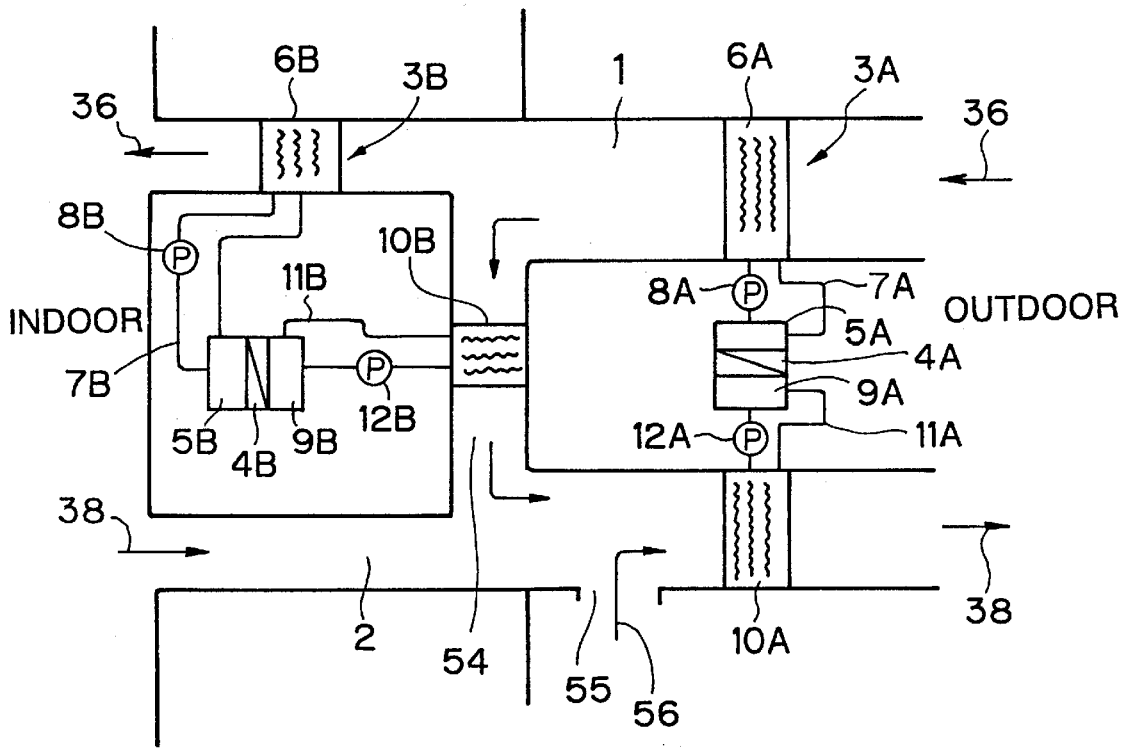
FIG. 18 is a schematic construction diagram of an air-conditioning ventilator according to a fifth embodiment of the present invention.

FIG. 18 schematically illustrates the construction of the air-conditioning ventilator according to the fifth embodiment of the present invention. According to this embodiment, a bypass passage 54 is formed between an air inlet passage 1 and an air outlet passage 2, and two heat exchangers are arranged side by side, one being an outdoor heat exchanger 3A and the other an indoor heat exchanger 3B.

The outdoor heat exchanger 3A is arranged with a second heat-absorbing-side heat transfer unit 6A thereof disposed on a side of an inlet of the air inlet passage 1 and with a second heat-dissipating-side heat transfer unit 10A disposed on a side of an outlet of the air outlet passage 2. A thermoelectric module 4A, a first heat-absorbing-side heat transfer unit 5A, a heat-absorbing-side circulating passage 7A, a heat-absorbing-side pump 8A, a first heat-dissipating-side heat transfer unit 9A, a heat-dissipating-side circulating passage 11A, a heat-dissipating-side pump 12A and the like of the outdoor heat exchanger 3A are disposed outdoors.

The indoor heat exchanger 3B is arranged with a second heat-absorbing-side heat transfer unit 6B thereof disposed on a side of an outlet of the air inlet passage 1 and with a second heat-dissipating-side heat transfer unit 10B thereof disposed in the bypass passage 54. A thermoelectric module 4B, a first heat-absorbing-side heat transfer unit 5B, a heat-absorbing-side circulating passage 7B, a heat-absorbing-side pump 8B, a first heat-dissipating-side heat transfer unit 9B, a heat-dissipating-side circulating passage 11B, a heat-dissipating-side pump 12B and the like of the indoor heat exchanger 3B are disposed outdoors.

The supply air 36 introduced into the air inlet passage 1 is first cooled through the second heat-absorbing-side heat transfer unit 6A. This supply air 36 is divided into substantially equal halves at a branching point of the bypass passage 54. One of the substantially equal halves of the supply air 36 is cooled further through the second heat-absorbing-side heat transfer unit 6B and at a temperature substantially equal to or slightly lower than a preset temperature of cooling, is supplied into a room.

The second heat-dissipating-side heat transfer unit 10B of the indoor heat exchanger 3B is arranged in the bypass passage 54. The other one of the substantially equal halves of the supply air 36, said the other half flowing through the bypass passage 54, has been subjected to primary cooling through the second heat-absorbing-side heat transfer unit 6A, so that the heat exchanger 3B has large cooling capacity.

Through the air outlet passage 2, foul indoor exhaust air 38 is exhausted at a flow rate substantially equal to that of the supply air 36 supplied into the room. The foul indoor exhaust air 38 then merges with the supply air 36 from the bypass passage 54. As the supply air 36 has been subjected to primary cooling through the second heat-absorbing-side heat transfer unit 6A, the temperature of the supply air 36 does not rise to any substantial extent despite the arrangement of the second heat-dissipating-side heat transfer unit 10B in the bypass passage 54. The temperature of the exhaust air 38 is therefore held low and at this temperature, the exhaust air 38 is fed to the second heat-dissipating-side heat transfer unit 10A and takes part in the primary cooling of the supply air 36.

Incidentally, designated at numeral 55 in the drawing is a replenishing opening formed at an intermediate point of the air outlet passage 2. Through the replenishing opening 55, replenishing air 56 may be added to maintain quantitative balancing between the supply air 36 and the exhaust air 38. To adjust the bypassing rate of the supply air 36 and the replenishing rate of the replenishing air 56, the bypass passage 54 and the replenishing opening 55 are each provided with flow rate adjusting means such as a damper although such flow rate adjusting means is not shown in the drawing. It is however to be noted that the replenishing opening 55 is not absolutely necessary.

In FIG. 18, the second heat-absorbing-side heat transfer unit 6A and the second heat-dissipating-side heat transfer unit 10A use the same thermoelectric module 4A commonly, and the second heat-absorbing-side heat transfer unit 6B and the second heat-dissipating-side heat transfer unit 10B employ the same thermoelectric module 4B commonly. It is however possible to connect the second heat-absorbing-side heat transfer unit 6A and the second heat-dissipating-side heat transfer unit 10A to different thermoelectric modules, respectively, and the second heat-absorbing-side heat transfer unit 6B and the second heat-dissipating-side heat transfer unit 10B to different thermoelectric modules, respectively.

Figure 19:
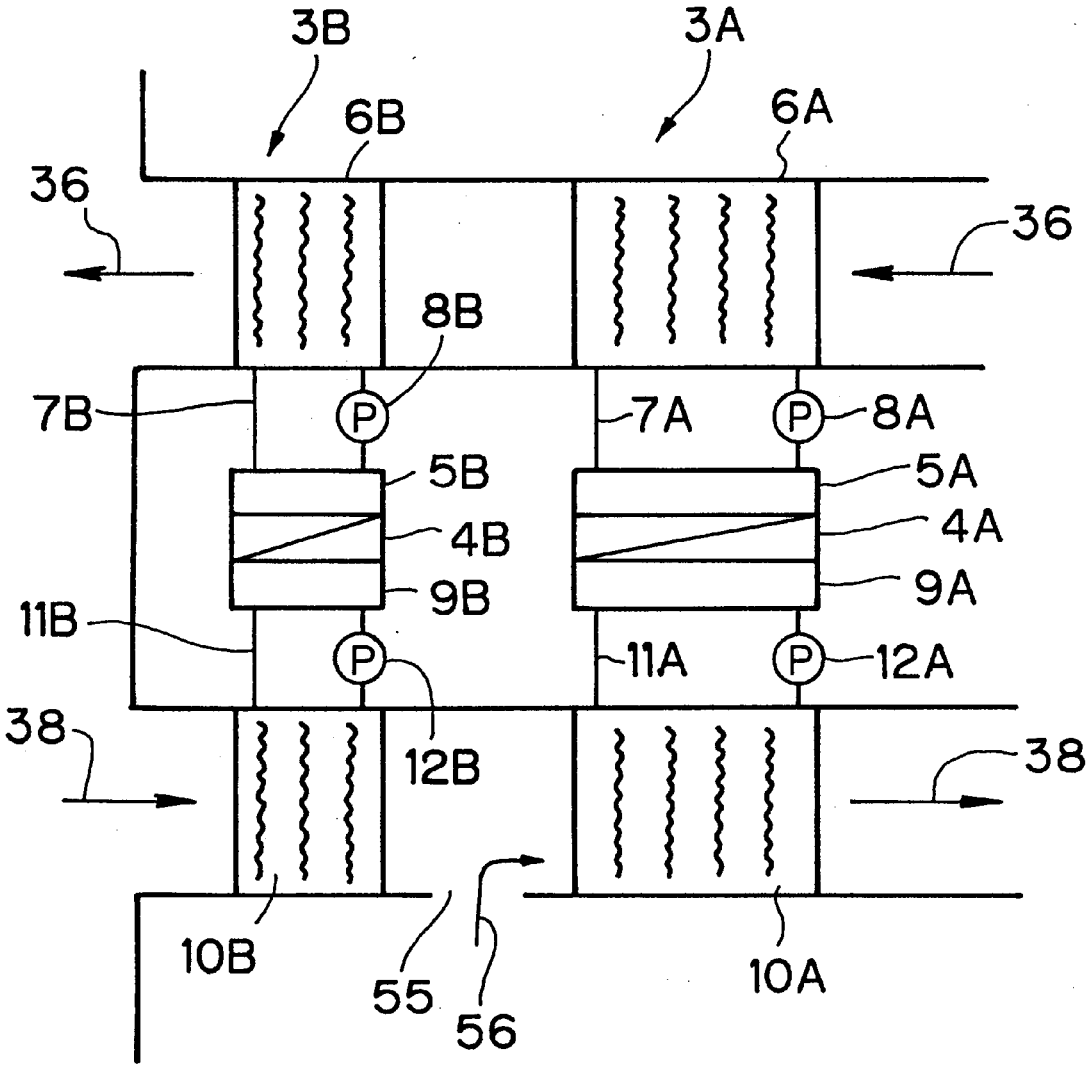
FIG. 19 is a schematic construction diagram of an air-conditioning ventilator according to a sixth embodiment of the present invention.

FIG. 19 schematically illustrates the construction of the air-conditioning ventilator according to the sixth embodiment of the present invention. In this embodiment, two heat exchangers are also arranged side by side, one being an outdoor heat exchanger 3A and the other an indoor heat exchanger 3B. A second heat-absorbing-side heat transfer unit 6A is disposed on an upstream side as viewed in the direction of a flow of supply air 36, and a second heat-absorbing-side heat transfer unit 6B is disposed on a downstream side as viewed in the direction of the flow of the supply air 36. A second heat-dissipating-side heat transfer unit 10B is arranged on an upstream side as viewed in the direction of a flow of exhaust air 38, and a second heat-dissipating-side heat transfer unit 10A is arranged on a downstream side as viewed in the direction of the flow of the exhaust air 38.

The outdoor heat exchanger 3A is designed with greater cooling capacity than the indoor heat exchanger 3B (for example, in the heat transfer areas of the heat transfer units, the circulating flow rates of the heat transfer medium, the feed electric power to the thermoelectric module, and/or the like). Accordingly, the supply air 36 is significantly cooled through the outdoor heat exchanger 3A, and its temperature adjusted through the indoor heat exchanger 3B.

Figure 20:
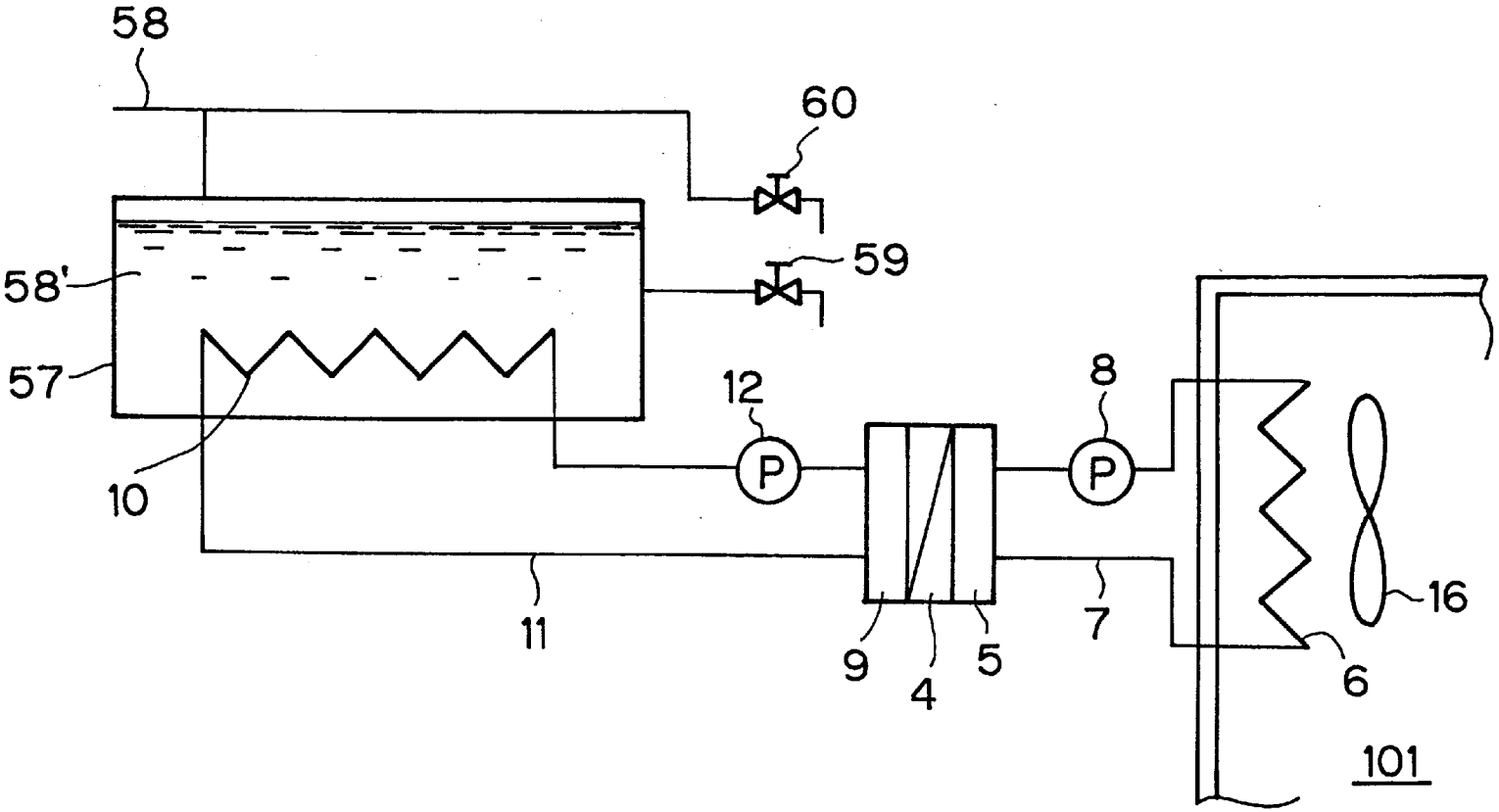
FIG. 20 is a schematic construction diagram of an air-conditioning ventilator according to a seventh embodiment of the present invention.

FIG. 20 schematically shows the construction of the air-conditioning ventilator according to the seventh embodiment of the present application. In this embodiment, a second heat-dissipating-side heat transfer unit 10 is arranged within a warm water tank 57. A cold water supply line 58 has a branch line through which cold water 58' such as tap water or well water is supplied to the warm water tank 57. Cold water 58' is stored in the warm water tank 57 and is warmed by heat dissipated from the second heat-dissipating-side heat transfer unit 10. Through a warm water faucet 59, warm water is obtained. Designated at numeral 60 is a cold water faucet, through which cold water is obtained. Although not shown in the drawing, a stirrer is additionally arranged within the warm water tank 57 to improve the recovery rate of heat.

Incidentally, the second heat-absorbing-side heat transfer unit 6 can also be used for dehumidification in addition to cooling. It is also possible to arrange second heat-dissipating-side heat transfer unit 10 of plural heat exchangers within the warm water tank 57.

When warm water is produced using heat dissipated from the second heat-dissipating-side heat transfer unit 10 as in this embodiment, the recovery rate of heat can be improved still further so that warm water can be easily produced. Further, it is better for the health to use the air-conditioning ventilator primarily for dehumidification at night or so rather than to strongly cool the indoor. This also makes it possible to save the power consumption.

Figure 21:
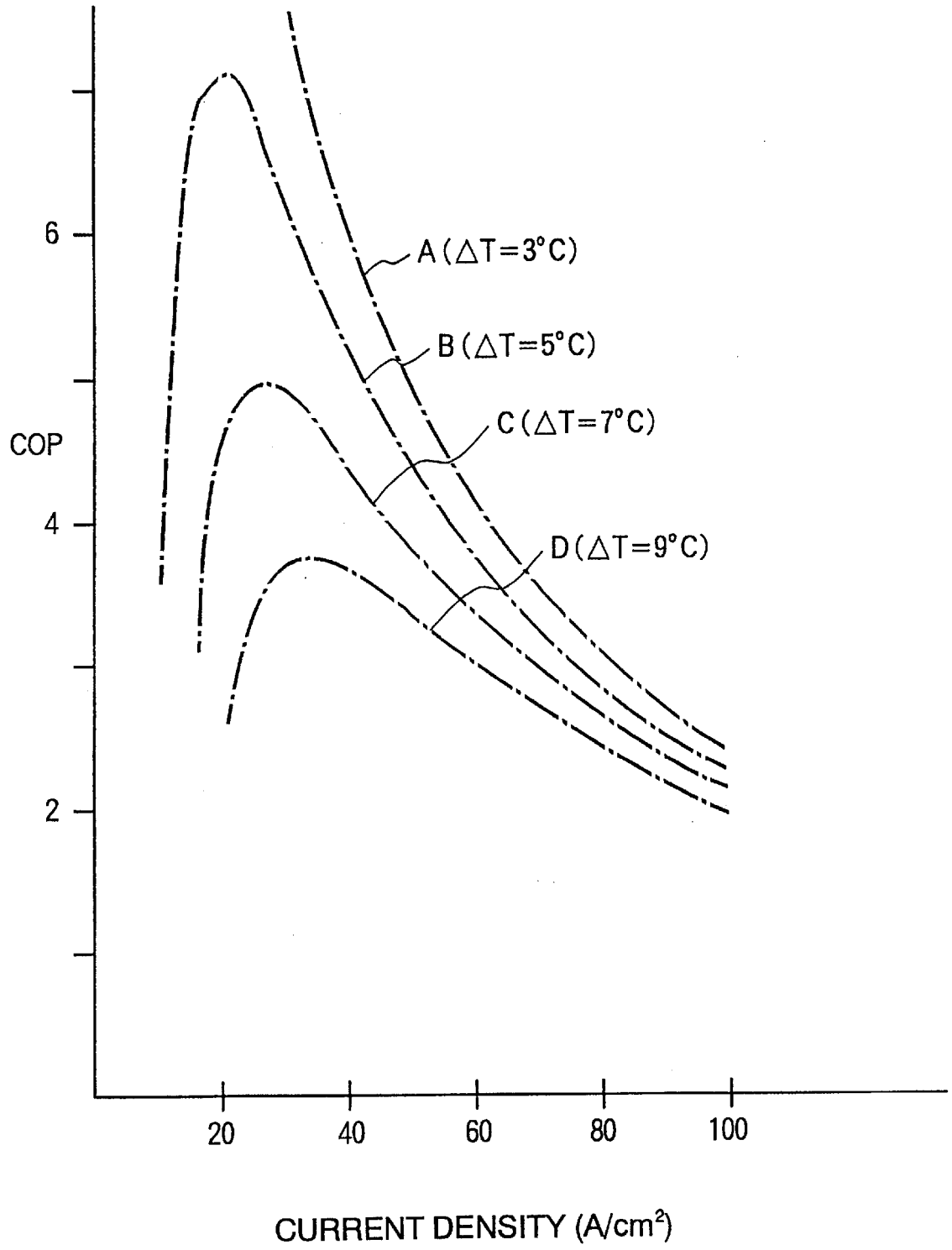
FIG. 21 is a characteristic diagram showing a relationship between current densities, which are supplied to a thermoelectric module at respective temperature differences, and corresponding coefficients of performance (COP).

FIG. 21 diagrammatically illustrates the relationship between densities of a current to be supplied to a heat exchanger and their corresponding coefficients of performance (COP). In the diagram, curve A is a characteristic curve when the temperature difference $\Delta T$ was 3° C., curve B is a characteristic curve when the temperature difference $\Delta T$ was 5° C., curve C is a characteristic curve when the temperature difference $\Delta T$ was 7° C., and curve D is a characteristic curve when the temperature difference $\Delta T$ was 9° C., A semiconductor chip employed in the above experiment was 0.16 cm in height. The thermal conductance of the semiconductor chip was 4 [W/(°C.cm$^2$)] per unit area on both a heat-absorbing side and a heat-dissipating side. Its Seebeck coefficient $\alpha$ was 205 [$\mu$V/K], its thermal conductivity $\kappa$ was 0.016 [W/(°C.cm)], its electrical conductivity $\sigma$ was 900 [S/cm], and its average temperature was 26.5° C. on both the heat-absorbing side and the heat-dissipating side.

As is apparent from the diagram, the coefficient of performance (COP) of the heat exchanger is at least 3 when the temperature difference $\Delta T$ is small (for example, when the temperature difference $\Delta T$ is not greater than 9° C.). Compared with air conditioners (COP: 2.5), the heat exchanger is higher in efficiency so that use of the heat exchanger can bring about marked advantageous effects. Especially when the temperature difference $\Delta T$ is 7° C. or smaller, COP is 4 or greater so that the heat exchanger is highly efficient and economical.

The air-conditioning ventilator according to the present invention can be remote-controlled from a place of visit by using a communications network to perform various operations such as driving, stopping and temperature adjustment.

The air-conditioning ventilator according to the present invention can be provided with a circuit which makes it possible to drive the ventilator by a solar battery. As an alternative, the drive circuit making use of the solar battery can be arranged in combination with a mains-powered drive circuit, so that the solar-battery-powered drive circuit and the mains-powered drive circuit can be switched over depending on the season and/or the time.

It is also possible to arrange sensors such as a dust concentration sensor, a smoke detection sensor and a smell sensor in a room. In this case, a control circuit is also arranged to automatically perform ventilation by detecting through the sensors a state that the room requires ventilation.

The air inlet passage can be equipped with means for feeding a substance which can provide mental relaxation (for example, a perfume or the like).

Further, it is desired to apply a heat-insulating measure to each air passage, for example, to provide each air passage with a heat-insulated duct or to additionally apply a sound deadening material for the reduction of acoustic noise (noise).

The embedments have been described in connection with cooling. The present invention can also be applied for heating. Further, the present invention can be applied for both cooling and heating by making it possible to change over the direction of a current to be fed to the heat-exchanger.

The embodiments have been described in connection with an exchange of heat between air and air. This invention can also be applied for an exchange of heat between air and liquid, an exchange of heat between liquid and liquid or an exchange of heat between air and non-air gas.

Moreover, the present invention can also be applied for following purposes:

(1) Centralized ventilation in central air conditioning of a house, hall or the like.

(2) Ventilation of vehicles such as automotive vehicles, buses, trains, ships and airplanes.

(3) Ventilation of placed susceptible to air fouling, such as toilets, barbecue restaurants, mah-jongg saloons, laboratories, and various workshops.

(4) Ventilation of incubators.

(5) Ventilation of greenhouses.

(6) Ventilation of bathrooms.

(7) Ventilation of clean rooms.

(8) Ventilation of cold storage houses, refrigerating storage houses and freezing storage houses.

(9) Maintenance of water temperature at constant level upon changing water for ornamental fish.

Having now fully described the invention, it will be apparent to one of ordinary skill in the art that many changes and modifications can be made thereto without departing from the spirit or scope of the invention as set forth herein.

What is claimed is:

1. An air-conditioning ventilator provided with an air inlet passage and an air outlet passage for ventilation and also with a heat exchanger making use of a thermoelectric module for effecting an exchange of heat with air flowing through one of said passages, wherein:

at least one of a heat-absorbing system and a heat-dissipating system of said heat exchanger is provided with a heat-transfer-medium-circulating system so that a heat transfer medium is forced to circulate in a liquid form for performing said exchange of heat.

2. An air-conditioning ventilator according to claim 1, wherein said heat-absorbing system and said heat-dissipating system are both provided with said heat-transfer-medium-circulating systems.

3. An air-conditioning ventilator according to claim 1, wherein said air inlet passage and said air outlet passage are both provided with said heat exchanger.

4. An air-conditioning ventilator according to claim 1, wherein on an upstream side of said heat exchanger as viewed in a flow direction of air, an additional heat exchanger is arranged with a thermal conductor thereof interposed between said air inlet passage and said an air outlet passage.

5. An air-conditioning ventilator according to claim 1, wherein:

a bypass passage is arranged communicating said air inlet passage and said air outlet passage with each other at intermediate parts thereof;

said heat exchanger is one of an outdoor heat exchanger and an indoor heat exchanger;

said outdoor heat exchanger making use of a thermoelectric module is arranged with a second heat-absorbing-side heat transfer unit thereof located on an upstream side, as viewed in a flowing direction of supply air, of a branching point of said bypass passage from said air inlet passage and also with a heat-dissipating-side heat transfer unit thereof located on a downstream side, as viewed in a flowing direction of exhaust air, of a merging point of said bypass passage with said air outlet passage; and said indoor heat exchanger making use of a thermoelectric module is arranged with a heat-absorbing-side heat transfer unit thereof located on a downstream side, as viewed in said flowing direction of supply air, of said branching point of said bypass passage from said air inlet passage and also with a heat-dissipating-side heat transfer unit located in said bypass passage.

6. An air-conditioning ventilator according to claim 5, wherein a replenishing opening for supplying replenishing air is arranged on said downstream side, as viewed in said flowing direction of exhaust air, of said merging point of said bypass passage with said air outlet passage.

7. An air-conditioning ventilator according to claim 1, wherein:

a bypass passage is arranged communicating said air inlet passage and said air outlet passage with each other at intermediate parts thereof;

said heat exchanger is one of an outdoor heat exchanger and an indoor heat exchanger;

said outdoor heat exchanger making use of a thermoelectric module is arranged with a second heat-absorbing-side heat transfer unit thereof located on an upstream side, as viewed in a flowing direction of supply air, of a branching point of said bypass passage from said air inlet passage and also with a heat-dissipating-side heat transfer unit thereof located on a downstream side, as viewed in a flowing direction of exhaust air, of a merging point of said bypass passage with said air outlet passage; and said indoor heat exchanger making use of a thermoelectric module is arranged with a heat-absorbing-side heat transfer unit thereof located on a downstream side, as viewed in said flowing direction of supply air, of said branching point of said bypass passage from said air inlet passage and also with a heat-dissipating-side heat transfer unit located on an upstream side, as viewed in said flowing direction of supply air, of said merging point of said bypass passage with said air outlet passage.

8. An air-conditioning ventilator according to claim 1, wherein said air-conditioning ventilator is constructed to control a temperature of supply air by adjusting at least two of a flow rate of supply air, a flow rate of exhaust air, a power supply to said thermoelectric module, a circulating flow rate of said heat transfer medium and a flow rate of air supplied to a second heat-dissipating-side heat transfer unit of said heat exchanger making use of said thermoelectric module.

9. An air-conditioning ventilator according to claim 1, wherein an heat-absorbing-side or heat-dissipating-side heat transfer unit, which is brought into direct contact with supply air to effect said exchange of heat, is arranged in said air inlet passage; and said thermoelectric module and said heat-transfer-medium circulating system are arranged outdoors.

10. An air-conditioning ventilator according to claim 3, wherein an heat-absorbing-side or heat-dissipating-side heat transfer unit, which is brought into direct contact with supply air to effect said exchange of heat, is arranged in said air inlet passage; a heat-dissipating-side or heat-absorbing-side heat transfer unit, which is brought into direct contact with exhaust air to effect said exchange of heat, is arranged in said air outlet passage; and said thermoelectric module and said heat-transfer-medium circulating system are arranged outdoors.

11. An air-conditioning ventilator according to claim 1, wherein said air-conditioning ventilator is constructed to make said heat transfer medium hit a substrate of said thermoelectric module in substantially a perpendicular direction.

* * * * *